US008559855B2

(12) United States Patent
Furuhata

(10) Patent No.: US 8,559,855 B2
(45) Date of Patent: Oct. 15, 2013

(54) IMAGE FORMING AGENT HOLDING CONTAINER, IMAGE FORMING DEVICE, AND METHOD OF FILLING IMAGE FORMING AGENT

(75) Inventor: Kota Furuhata, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 315 days.

(21) Appl. No.: 12/939,013

(22) Filed: Nov. 3, 2010

(65) Prior Publication Data

US 2011/0222915 A1 Sep. 15, 2011

(30) Foreign Application Priority Data

Mar. 10, 2010 (JP) ..... 2010-052967

(51) Int. Cl.
*G03G 15/04* (2006.01)

(52) U.S. Cl.
USPC ..... 399/262; 399/252; 399/258; 347/86; 222/649

(58) Field of Classification Search
USPC ..... 399/12, 252, 258, 262, 263; 222/469, 222/DIG. 1; 347/86
See application file for complete search history.

(56) References Cited

U.S. PATENT DOCUMENTS

| | | | | |
|---|---|---|---|---|
| 5,839,027 | A | 11/1998 | Sahay et al. | |
| 2002/0159787 | A1* | 10/2002 | Chadani et al. | 399/109 |
| 2008/0260422 | A1* | 10/2008 | Sasae et al. | 399/119 |
| 2010/0232813 | A1 | 9/2010 | Okamoto | |

FOREIGN PATENT DOCUMENTS

| | | | |
|---|---|---|---|
| AU | 2010200937 | A1 | 10/2010 |
| JP | 2001-242692 | A | 9/2001 |
| JP | 2005-031109 | A | 2/2005 |
| JP | 2005-250002 | A | 9/2005 |
| JP | 4371177 | B1 | 9/2009 |

OTHER PUBLICATIONS

Australian Office Action dated Jun. 30, 2011 for corresponding Australian patent application No. 2010246543.
Japanese Office Action dated Apr. 16, 2010 for Japanese patent application No. 2010-052967.
Taiwanese Notification of Examination Opinion, dated Jun. 20, 2013, issued in corresponding Taiwanese Patent Application No. 099143437.

* cited by examiner

*Primary Examiner* — Walter L Lindsay, Jr.
*Assistant Examiner* — Jessica L Eley
(74) *Attorney, Agent, or Firm* — Sughrue Mion, PLLC

(57) ABSTRACT

There is provided an image forming agent holding container having a container body that is installable into and removable from an image forming device body and in which an ejection hole for use in ejection of image forming agent is formed, an opening/closing part that is shiftably mounted on the container body so as to open and close the ejection hole, and a manipulating part turnably supported by the container body to be used for shifting the opening/closing part relative to the container body, the manipulating part shifting to and from an open position to place the ejection hole in an open state, a sealing position to place the ejection hole in a sealed state, and a fitting position to fit the manipulating part to the container body.

12 Claims, 26 Drawing Sheets

IMAGE FORMING AGENT HOLDING CONTAINER, IMAGE FORMING DEVICE, AND METHOD OF FILLING IMAGE FORMING AGENT

CROSS-REFERENCE TO RELATED APPLICATIONS

This application is based on and claims priority under 35 USC 119 from Japanese Patent Application No. 2010-052967 filed Mar. 10, 2010.

BACKGROUND

Technical Field

The present invention relates to an image forming agent holding container, an image forming device, and a method of filling image forming agent.

SUMMARY

According to an aspect of the present invention, there is provided an image forming agent holding container including a container body that is installable into and removable from an image forming device body and in which an ejection hole for use in ejection of image forming agent is formed, an opening/closing part that is shiftably mounted on the container body so as to open and close the ejection hole, and a manipulating part turnably supported by the container body to be used for shifting the opening/closing part relative to the container body, the manipulating part shifting to and from an open position to place the ejection hole in an open state, a sealing position to place the ejection hole in a sealed state, and a fitting position to fit the manipulating part to the container body.

BRIEF DESCRIPTION OF THE DRAWINGS

An exemplary embodiment of the present invention will be described in detail based on the following figures, wherein:

FIG. 11A illustrates how the control lever of the holding container pertaining to the exemplary embodiment of the present invention moves, wherein FIG. 11A is a profile of the control lever in its first position;

FIG. 11B illustrates how the control lever of the holding container pertaining to the exemplary embodiment of the present invention moves, wherein FIG. 11B is a profile of the control lever in its second position;

FIG. 11C illustrates how the control lever of the holding container pertaining to the exemplary embodiment of the present invention moves, wherein FIG. 11C is a profile of the control lever in its third position;

FIG. 11D illustrates how the control lever of the holding container pertaining to the exemplary embodiment of the present invention moves, wherein FIG. 11D is a profile of the control lever in its fourth position;

FIG. 12A illustrates how the control lever of the holding container pertaining to the exemplary embodiment of the present invention moves, wherein FIG. 12A is a sectional view of the control lever in its first position;

FIG. 12B illustrates how the control lever of the holding container pertaining to the exemplary embodiment of the present invention moves, wherein FIG. 12B is a sectional view of the control lever in its second position;

FIG. 12C illustrates how the control lever of the holding container pertaining to the exemplary embodiment of the present invention moves, wherein FIG. 12C is a sectional view of the control lever in its third position;

FIG. 13A illustrates how the control lever and the opening/closing part pertaining to the exemplary embodiment of the present invention operate relative to each other, wherein FIG. 13A is a perspective view of the state of the control lever and the opening/closing part at a point of time on the way of the movement of the control lever from its fourth position to third position;

FIG. 13B illustrates how the control lever and the opening/closing part pertaining to the exemplary embodiment of the present invention operate relative to each other, wherein FIG. 13B is a perspective view of the state of the control lever and the opening/closing part at a point of time when the control lever is arranged in its third position;

FIG. 14A illustrates how the control lever of the holding container pertaining to the exemplary embodiment of the present invention operates, wherein FIG. 14A is a first perspective view showing the control lever at one point of time on the way of movement from its fourth position to third position;

FIG. 14B illustrates how the control lever of the holding container pertaining to the exemplary embodiment of the present invention operates, wherein FIG. 14B is a second perspective view showing the control lever at another point of time on the way of movement from its fourth position to third position;

FIG. 22A illustrates how a holding container is mounted into a mounting device, wherein FIG. 22A is a right side profile showing the holding container in a state in which a controller is arranged in its second position;

FIG. 22B illustrates how a holding container is mounted into a mounting device, wherein FIG. 22B shows a right side profile of the holding container and a section of the mounting device;

DETAILED DESCRIPTION

Next, an exemplary embodiment of the present invention will be described in detail with reference to the accompanying drawings.

Figure 1:
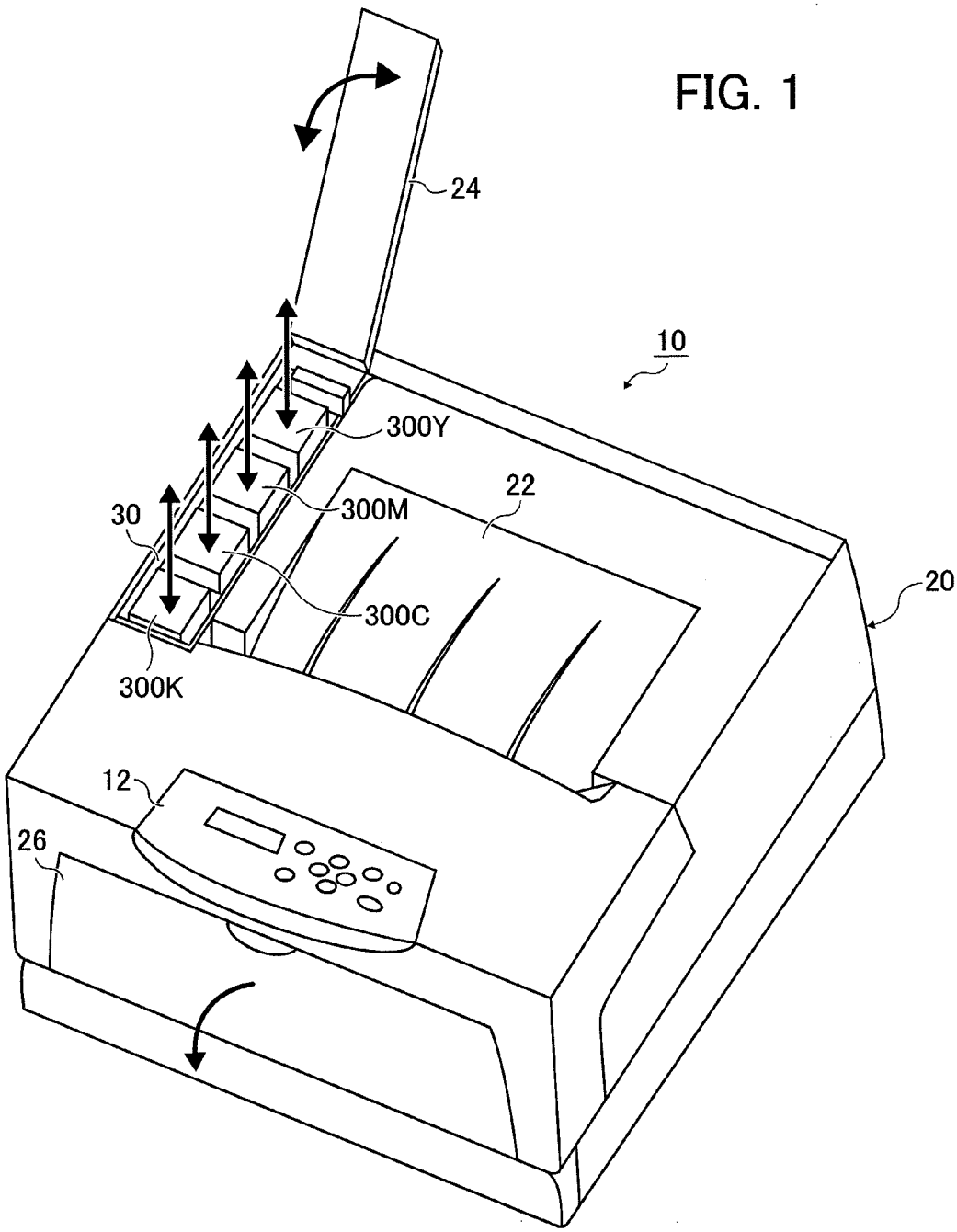
FIG. 1 is a perspective view showing an image forming device pertaining to an exemplary embodiment of the present invention.

FIG. 1 shows an image forming device 10 pertaining to the exemplary embodiment of the present invention. As shown in FIG. 1, the image forming device 10 has an image forming device body 20, and the upper part of the image forming device body 20 is used as an ejection receptacle 22 onto which paper sheets each with an image formed thereon are ejected. Also, a control panel 12 to be used as a controller is mounted on the front side of the image forming device body 20.

Further, the image forming device body 20 is mounted with an opening/closing part 24 for mounting use and an opening/closing part 26 for paper feed use, each to be openable and closable. The opening/closing part 24 for mounting use is opened when holding containers 300Y, 300M, 300C and 300K to be used as image forming agent holding containers are to be mounted into the image forming device body 20 and when the holding containers 300Y, 300M, 300C and 300K are to be detached out of the image forming device body 20, and is closed when an image is to be formed. The opening/closing part 26 for paper feed use is opened when a paper sheet on which an image is to be formed is fed from the front side of the image forming device body 20. Incidentally, though the opening/closing part 24 for mounting use is opened and closed in the way illustrated in FIG. 1, pivoting on the rear part of the image forming device body 20 (a way in which the fulcrum is formed on the shorter side of the opening/closing part 24 for mounting use), the form shown in FIG. 1 is not the only possible way, but a form in which the opening/closing part 24 for mounting use is turned pivoting on a flank of the image forming device body 20 (a way in which the fulcrum is formed on the longer side of the opening/closing part 24 for mounting use) may as well be used.

Also, a mounting device 30 into which the holding containers 300Y, 300M, 300C and 300K are to be mounted is provided in the image forming device body 20.

The holding containers 300Y, 300M, 300C and 300K respectively hold yellow toner, magenta toner, cyan toner and black toner to be used as image forming agents. The holding containers 300Y, 300M and 300C are the same in shape and size, supposed to hold the same volumes of toner. The holding container 300K is formed longer and larger in cubic measure and can hold greater volumes of toner than the holding containers 300Y, 300M and 300C.

The holding containers 300Y, 300M and 300C and the holding container 300K, though different in the holdable volume of toner, have the same members and functions. In the following description, except where any specific holding container is to be referred to, the holding containers 300Y, 300M, 300C and 300K will be generically referred to as the holding containers 300.

Figure 2:
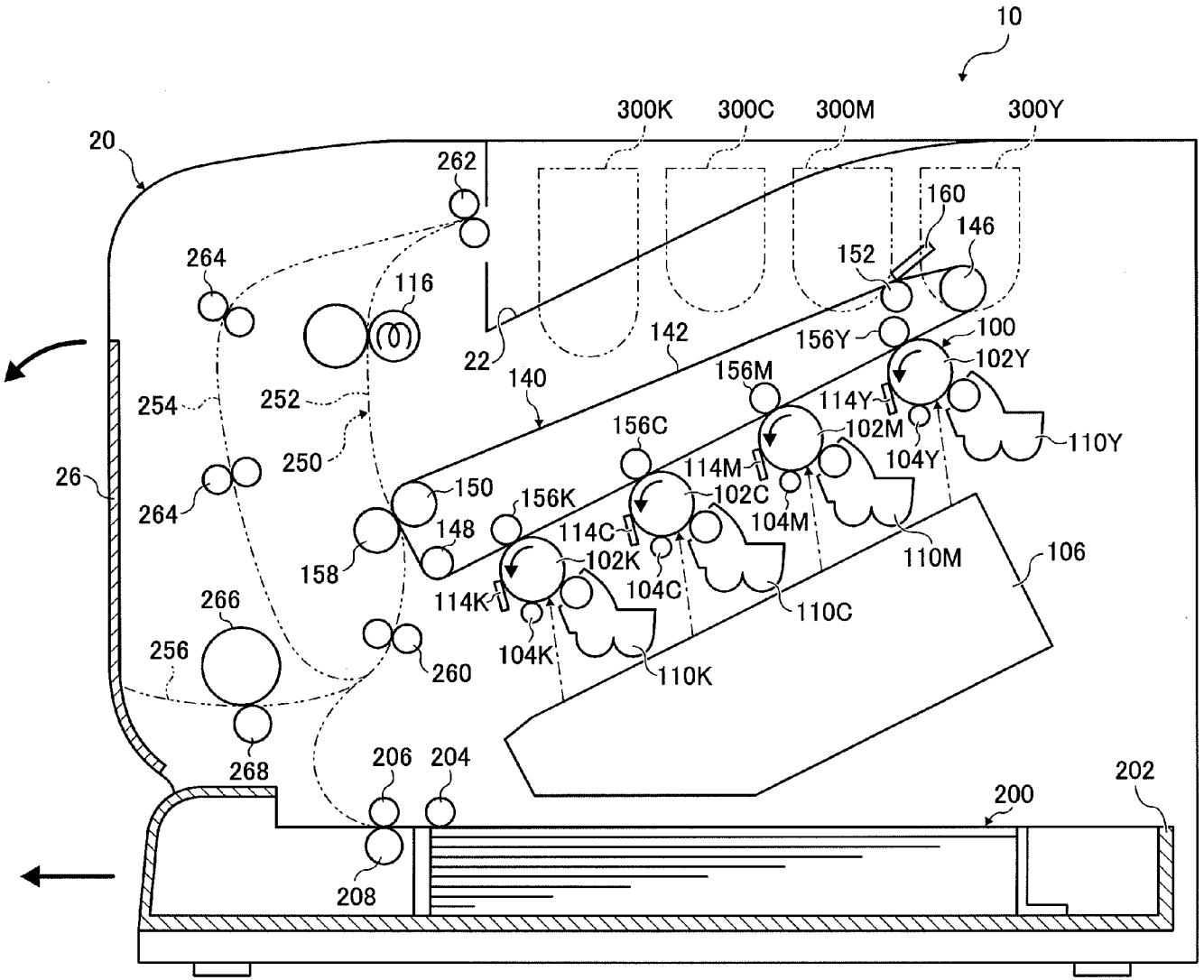
FIG. 2 shows a side sectional view of the image forming device pertaining to the exemplary embodiment of the present invention.
Figure 3:
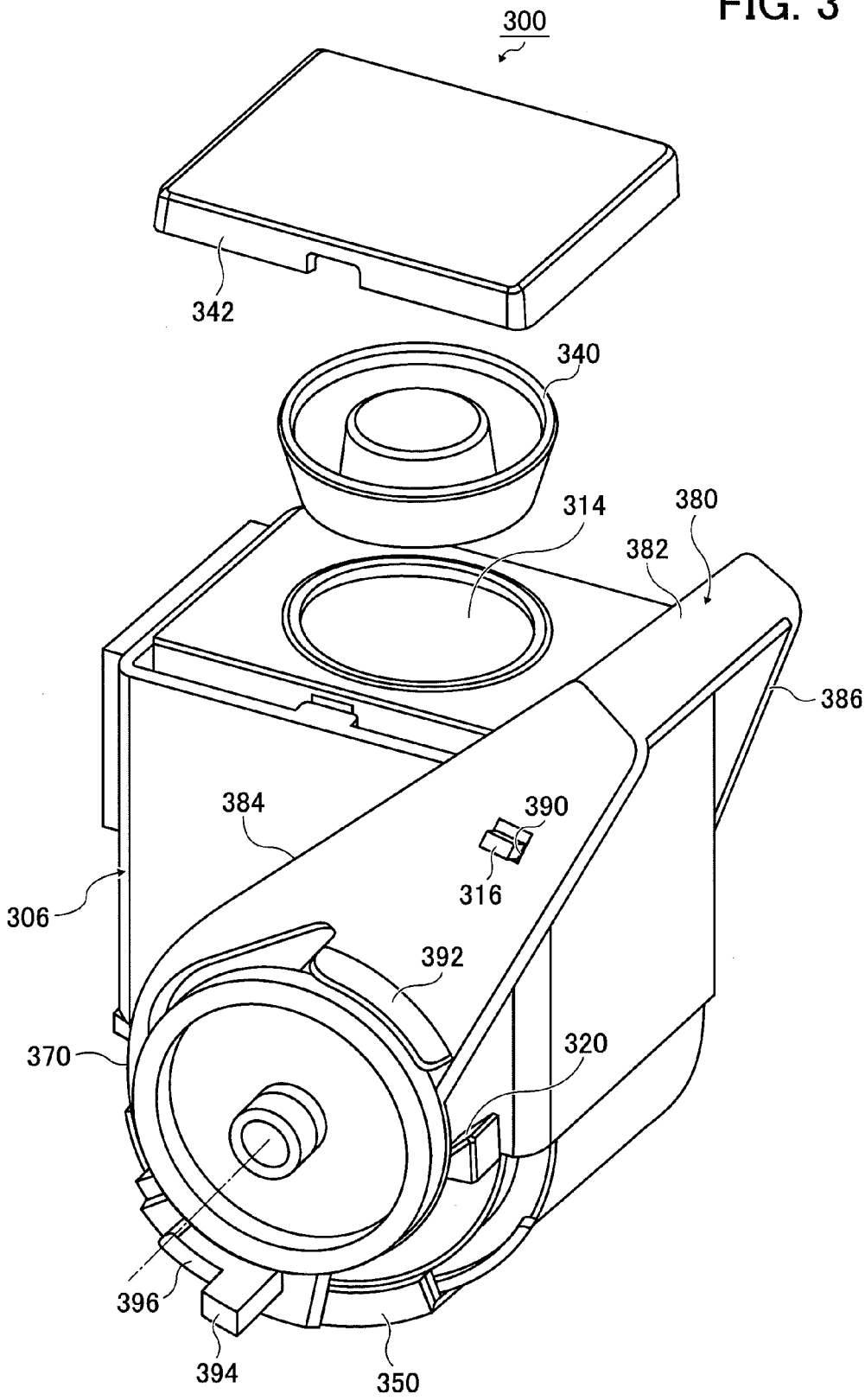
FIG. 3 is a first perspective exploded view of a holding container pertaining to the exemplary embodiment of the present invention.

FIG. 2 shows a section of the image forming device 10.

As shown in FIG. 2, an image forming part 100 and a paper feeder 200 for feeding paper sheets to the image forming part 100 are mounted in the image forming device body 20. Further, a carriage path 250 for use in carrying paper sheets is formed in the image forming device body 20.

The image forming part 100 has photoreceptor drums 102Y, 102M, 102C and 102K to be used as image holders, electrifiers 104Y, 104M, 104C and 104K for respectively electrifying the photoreceptor drums 102Y, 102M, 102C and 102K, an electrostatic latent image forming device 106 for forming latent electrostatic images by irradiating with light the photoreceptor drums 102Y, 102M, 102C and 102K electrified by the electrifiers 104Y, 104M, 104C and 104K, and developing devices 110Y, 110M, 110C and 110K for respectively forming a yellow toner image, a magenta toner image, a cyan toner image and a black toner image by developing with toner the electrostatic latent images formed on the surfaces of the photoreceptor drums 102Y, 102M, 102C and 102K by the electrostatic latent image forming device 106.

The developing devices 110Y, 110M, 110C and 110K are respectively supplied by the holding containers 300Y, 300M, 300C and 300K with yellow toner, magenta toner, cyan toner and black toner.

Further, the image forming part 100 has a transfer device 140 for transferring to a paper sheet the yellow toner image, the magenta toner image, the cyan toner image and the black toner image respectively formed by the developing devices 110Y, 110M, 110C and 110K, cleaning devices 114Y, 114M, 114C and 114K for cleaning the surfaces of the photoreceptor drums 102Y, 102M, 102C and 102K, respectively, and a fixing device 116 for fixing onto the paper sheet the toner images transferred by the transfer device 140.

The transfer device 140 has a belt-shaped transfer medium 142 that transfers the yellow toner image, the magenta toner image, the cyan toner image and the black toner image, formed on the photoreceptor drums 102Y, 102M, 102C and 102K, so as to superpose them one over another. The transfer medium 142 is turnably supported by supporting rollers 146, 148, 150 and 152 used as supporting members.

Further, the transfer device 140 has first transfer rollers 156Y, 156M, 156C and 156K to be used as first transfer devices for transferring the yellow toner image, the magenta toner image, the cyan toner image and the black toner image, respectively formed on the photoreceptor drums 102Y, 102M, 102C and 102K, to the transfer medium, and a second transfer roller 158 to be used as a second transfer device for transferring to the paper sheet the yellow toner image, the magenta toner image, the cyan toner image and the black toner image transferred to the transfer medium 142. The transfer device 140 also has a cleaning device 160 for cleaning the surface of the transfer medium 142.

The paper feeder 200 has a paper storage part 202 made up of a cassette for instance, a pickup roller 204 for picking up the topmost sheet of paper stored in the paper storage part 202, a carrying roller 206 for carrying toward the image forming part 100 the paper sheet picked up by the pickup roller 204 and a separating roller 208 that is in contact with the carrying roller 206 and separates paper sheets between itself and the carrying roller 206. The paper storage part 202, so configured as to be drawn out toward the front of the image forming device body 20 (leftward in FIG. 2) for instance, is replenished with paper sheets in a state in which it is drawn out of the image forming device body 20.

The carriage path 250 includes a main carriage path 252, a reverse carriage path 254 and an auxiliary carriage path 256.

The main carriage path 252, which is a carriage path over which paper sheets supplied from the paper feeder 200 are carried to the ejection receptacle 22, is mounted with a registration roller 260, the second transfer roller 158 referred to above, the fixing device 116 also referred to above and an ejection roller 262 in this order from the upstream side of the sheet carrying direction downward along the main carriage path 252. The registration roller 260 starts turning from an unmoving state at a prescribed timing and supplies a paper sheet to the contact part between the transfer medium 142 and the second transfer roller 158 so as to match the timing of the transfer of a toner image to the transfer medium 142.

The ejection roller 262 ejects the paper sheet on which the toner image has been fixed by the fixing device 116 to the ejection receptacle 22. Also the ejection roller 262, when images are to be formed on both faces of the sheet, it may turn in a direction reverse to the case in which the sheet is to be ejected to the ejection receptacle 22, and feed to the reverse carriage path 254 the sheet on one of whose faces an image has been formed.

The reverse carriage path 254 is used when a sheet on one of whose faces an image has been formed is to be supplied, while reversing it, to the side upstream of the registration roller 260 again. Along the reverse carriage path 254, for instance two reverse carriage rollers 264 and 264, are mounted.

The auxiliary carriage path 256 is a carriage path that is used when a paper sheet is fed from the front side of the image forming device body 20 in a state in which the opening/closing part 26 for paper feed use is open toward the image forming device body 20. Along the auxiliary carriage path 256, an auxiliary carriage roller 266 that carries paper sheets toward the registration roller 260 and a separating roller 268 that comes into contact with the auxiliary carriage roller 266 and is used for separating the sheets are mounted.

FIG. 3 through FIG. 7 show a holding container 300.

As already stated, the holding containers 300Y, 300M and 300C are the same in shape and size, and the holding container 300K is larger in capacity than the holding containers 300Y, 300M and 300C. FIG. 3 through FIG. 7 show a holding container 300 to be used as the holding container 300Y, 300M or 300C.

As shown in FIG. 3 through FIG. 7, each holding container 300 has a container body 306, an opening/closing part 350, a control lever 380 having a manipulating part 382 and a gear 370 to be used as a drive transmission part. In the holding container 300, an ejection hole 312 is formed in a position which is downward in the direction of gravity in a state in which the container is mounted in the image forming device body 20 (see FIG. 1). Toner ejected through the ejection hole 312 is supplied to a developing device 110 to be used for image formation.

Also, the container body 306 has, in a position upward in the direction of gravity in a state in which the body is mounted in the image forming device body 20, a replenishing hole 314 to be used for replenishing the container body 306 with toner. The replenishing hole 314 is formed in the upward face of the container body 306, and the container body 306 is replenished with toner by dropping it through the replenishing hole 314 from above in the direction of gravity. The shape of the replenishing hole 314 as viewed from above in the direction of gravity is substantially circular.

Also, a fixing stub 316 is so formed on the front face of the container body 306 as to protrude forward. The fixing stub 316 is used for fixing the manipulating part 382 of the control lever 380 in a third position to be described in more detail afterwards. Further, the fixing stub 316 is also used as a shift forbidding part that forbids, while allowing the manipulating part 382 to shift from a fourth position to be described in more detail afterwards to one of a first position and a second position both to be described in more detail afterwards, the manipulating part 382 from shifting from the first position or the second position to the fourth position. Details of the fixing stub 316 including its shape will be described afterwards.

Figure 5:
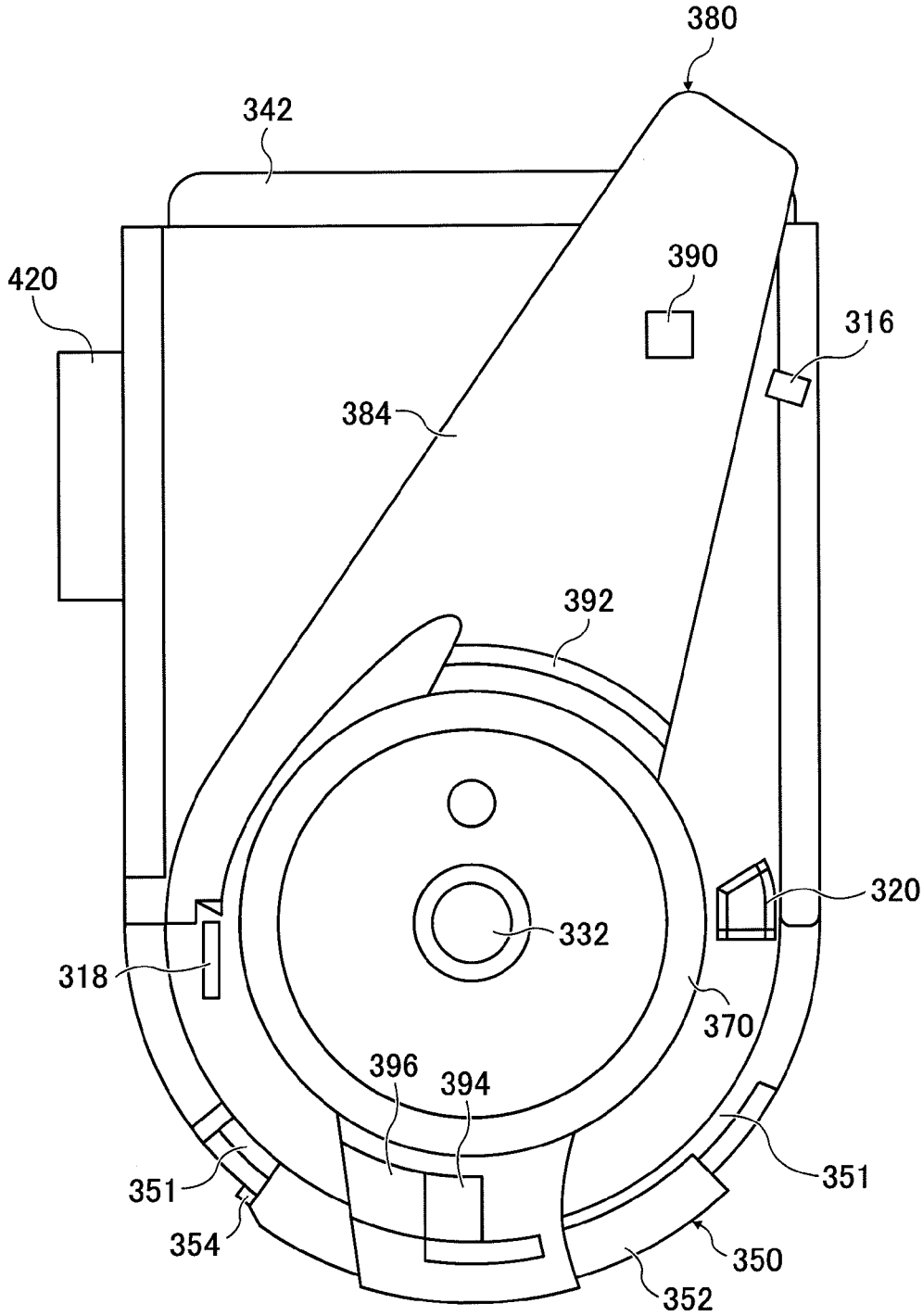
FIG. 5 is a profile of the holding container pertaining to the exemplary embodiment of the present invention.

Also, on a side of the container body 306 toward the front, a forbidding stub 318 is so formed as to protrude forward (see FIG. 5). The forbidding stub 318 is used as a shift forbidding part that forbids the manipulating part 382 of the control lever 380 from shifting from a second position to be described in more detail afterwards to a first position to be described in more detail afterwards. The forbidding stub 318 further constitutes part of an opening forbidding unit that forbids the ejection hole 312 from being opened in a state in which the container body 306 is not positioned beside the image forming device body 20. Further details of the opening forbidding device will be described afterwards.

Further in a position ahead of the container body 306 and close to the gear 370, a protective stub 320 is formed. The protective stub 320 protects the gear 370 by making it difficult for the tooth-formed face of the gear 370 to strike vehemently against any other object.

On the rear face of the container body 306, a supporting stub 324 of a columnar shape is formed to support the control lever 380 rotatably. Also, on the front face of the container body 306, a supporting stub 325 is formed to support the control lever 380 rotatably in a similar way to the supporting stub 324.

On the inner wall face of the front side of the container body 306, a fitting part 307*a* for use in fitting a mixing device 330, to be described in more detail afterwards, to the container body 306 is formed. Also, on the inner wall face of the rear side of the container body 306, a fitting part 307*b* for use in fitting the mixing device 330 to the container body 306 is formed.

Within the container body 306, the mixing device 330 used for mixing the toner held in the container body 306 is fitted. The mixing device 330 has a function not only to stir the toner held in the container body 306 but also to carry the toner held in the container body 306. The mixing device 330 has a shaft 322 so fitted to the container body 306 as to be rotatable around a rotation shaft 332, a parallel part 334 which is fitted to the shaft 322 and substantially parallel to the shaft 322, and a carrying plate 336 fitted to the shaft 322. The tip of the carrying plate 336, made up of an elastic filmy sheet, is so disposed as to be in contact with the inner face of the container body 306. In the shaft 332, a snap-in recess 332*c* is formed at its forward end 332*a*. Also, the rear end 332*b* side of the shaft 332 is smaller in diameter than other parts. The mixing device 330 may as well be formed as appropriate for only one of the two functions of mixing and carrying. However, it is more likely to have both mixing and carrying functions because it is a device intended for mixing toner, which is powder.

Figure 6:
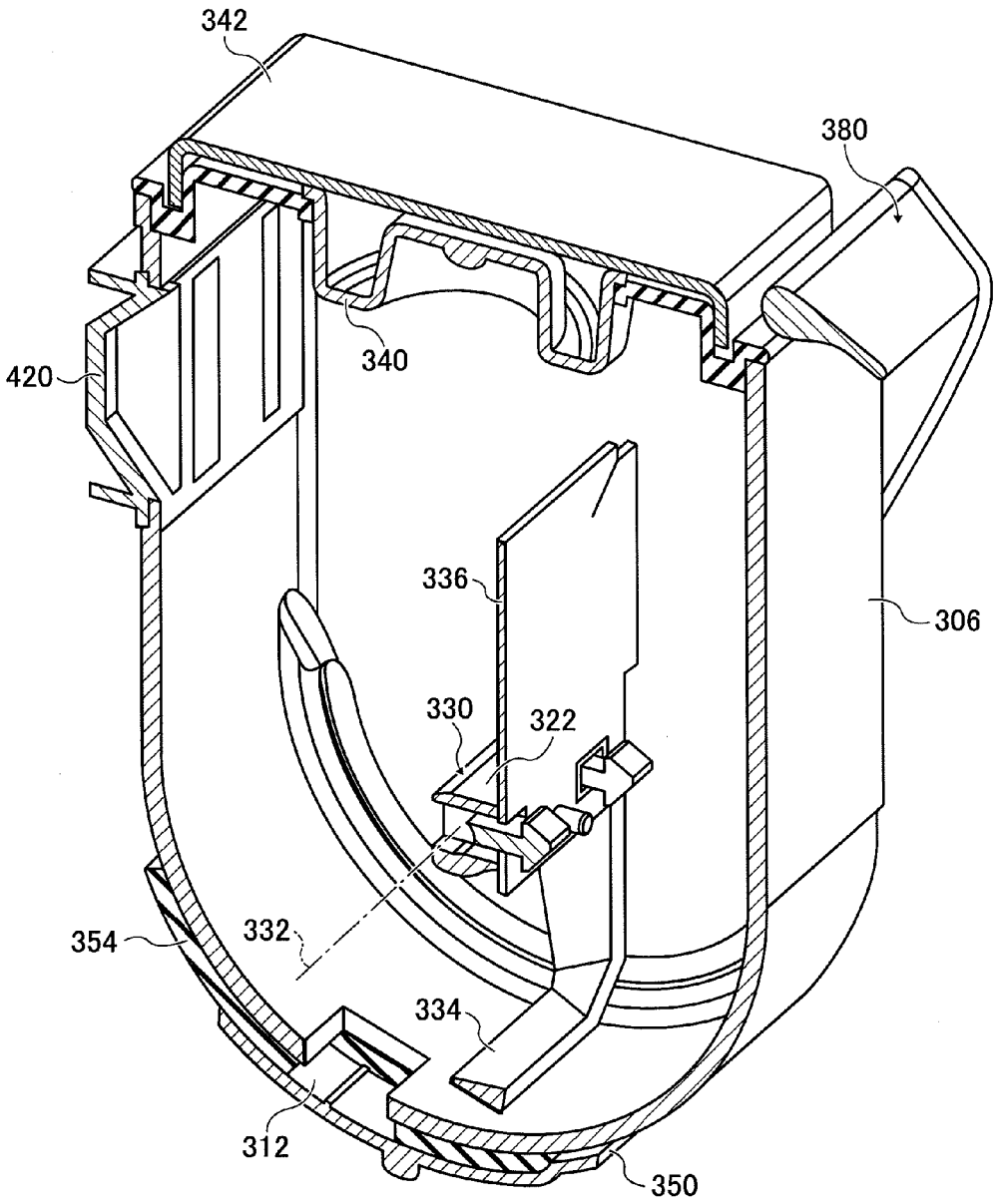
FIG. 6 is a perspective view showing a perpendicular section the holding container pertaining to the exemplary embodiment of the present invention.

Further, as shown in FIG. 6, the mixing device 330 can be so arranged as to make its longitudinal direction coincide with the up-and-down direction, the direction in which toner is put into the container body 306 via the replenishing hole 314. Filling the container body 306 with toner in this state in which the mixing device 330 is arranged in such a position makes it difficult for the downward movement of the toner to be obstructed by the mixing device 330, and enables toner to be smoothly put into the vertically long container body 306.

Figure 7:
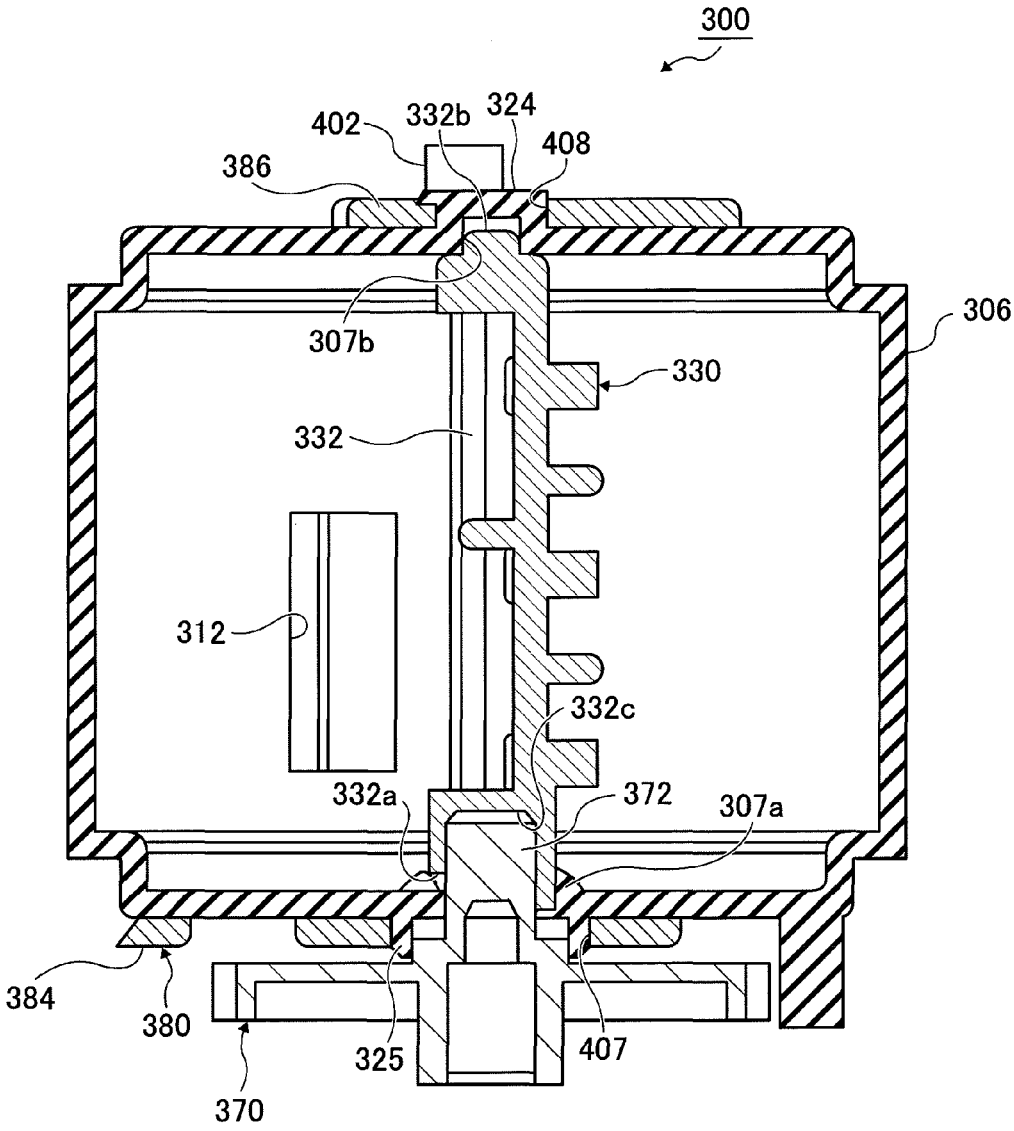
FIG. 7 is a perspective view showing a transverse section of the holding container pertaining to the exemplary embodiment of the present invention.

The mixing device 330, as shown in FIG. 7, is fitted to the device body 306 by placing the front end 332*a* of the shaft 332 on the fitting part 307*a* of the container body 306, placing the rear end 332*b* of the shaft 332 on the fitting part 307*b* of the container body 306 and pressing the shaft part 372 of the gear 370 into the snap-in recess 332*c*.

Further, a distinguishing member 420 to be used as a distinguishing part is mounted on the left flank of the container body 306. The distinguishing member 420 has multiple, for instance three, convexes 422, and a concave 424 is formed between each adjoining pair of convexes 422. Each of the concaves 424 is so formed that at least one factor out of the number, position and width differs with the type of the toner held in the pertinent container body 306. For instance, depending on the color of the toner of a container body 306, yellow, magenta or cyan, at least one factor out of the number, position and width of its concave or concaves 424 differs. Even where toners of the same color, for instance black toners, are held, if they are to be used for different device types or differ in characteristics, at least one factor out of the number, position and width of the concaves 424 differs with the device type or in characteristics.

The distinguishing member 420 bears a mark that enables the operator or the like to distinguish the toner to be filled or already filled is printed or otherwise placed, and this mark is arranged in a position that can be visually recognized at least in a state in which the control lever 380 is arranged in its second position to be described afterwards. This mark is also placed on the control lever 380 and the upper face of a lid member 340 to be described afterwards.

Figure 4:
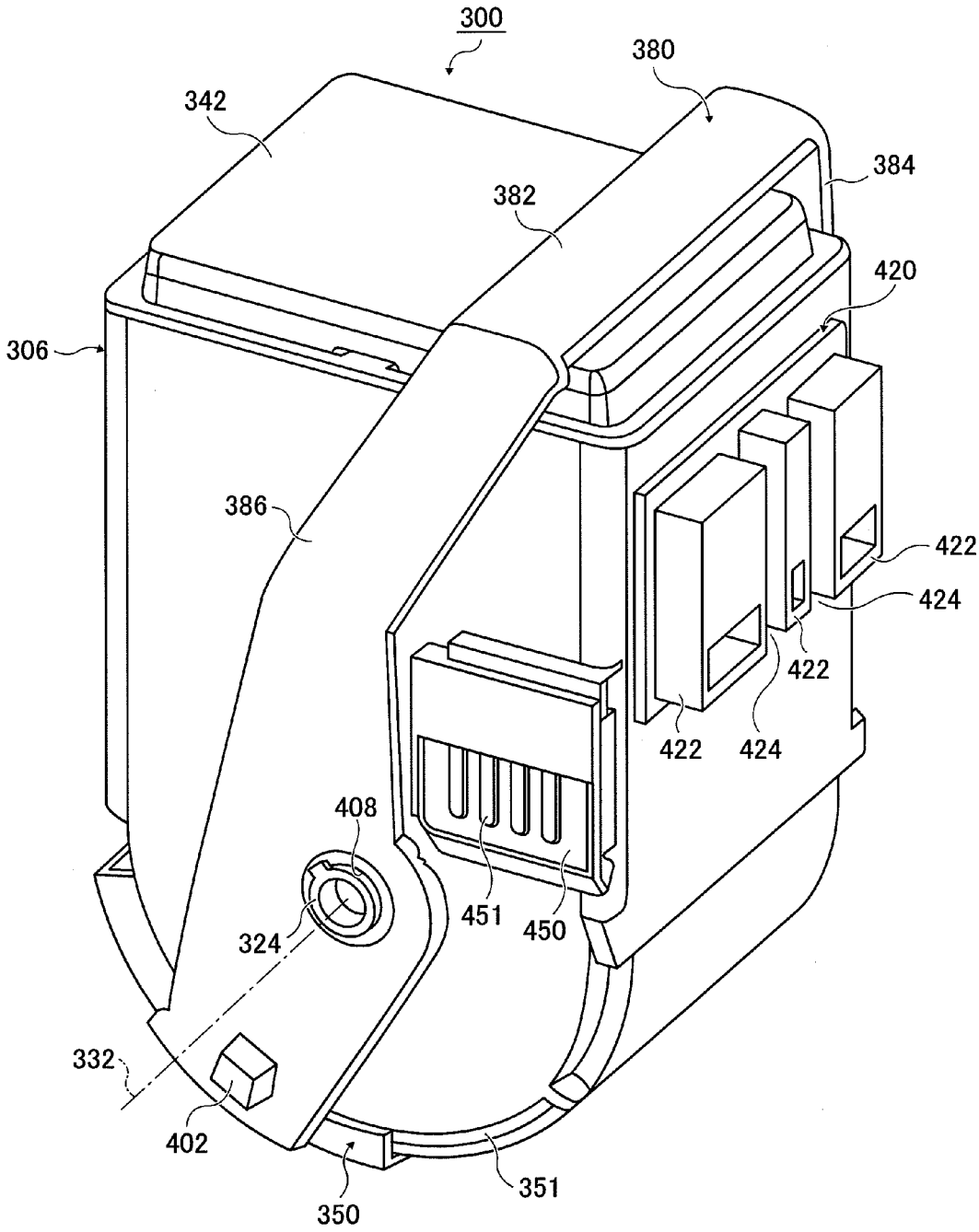
FIG. 4 is a second perspective view of the holding container pertaining to the exemplary embodiment of the present invention.

Also, a storage medium 450 to be used as a storage unit is mounted on the rear face of the container body 306 to be detachable from the container body 306. The storage medium 450 can be connected to a data writing device (not shown) disposed toward the image forming device body 20, and data such as the number of images formed of the toner held in the pertinent holding container 300 is written into it from the data writing device. Connecting terminals 451 of the storage medium 450 extend long in the vertical direction, with their lower parts including the bottoms in the vertical direction being exposed, and four of them are disposed side by side in the horizontal direction. As shown in FIG. 4, when the control lever 380 is in its second position to be described afterwards (a state in which the opening/closing part 350 linked to the control lever 380 closes the ejection hole 312, namely the state shown in FIG. 4), its rear arm part 386 evades from underneath the connecting terminals of the storage medium 450.

The opening/closing part 350 is so fitted as to be movable to a position underneath the container body 306. Shifting of the opening/closing part 350 to underneath the container body 306 causes the ejection hole 312 to be open or closed. The opening/closing part 350 has an opening/closing member 352 so mounted as to be shiftable relative to the container body 306 and a sealing member 354 disposed between the opening/closing member 352 and the container body 306 and used for sealing the ejection hole 312.

The control lever 380 has the manipulating part 382 as stated above. The manipulating part 382, which is a part arranged in a position opposing the replenishing hole 314 of the control lever 380 and so supported as to be rotatable relative to the container body 306, is used for shifting the opening/closing part 350 relative to the container body 306. The control lever 380 has a front arm part 384 extending from the front end of the manipulating part 382 and the rear arm part 386 extending from the rear end of the manipulating part 382. In the front arm part 384, a through hole 407 to allow the supporting stub 325, formed on the front part of the container body 306, to be snapped in is formed. Also in the rear arm part 386, a through hole 408 to allow the supporting stub 324, formed on the rear part of the container body 306, to be snapped in is formed.

By inserting the supporting stub 325 into the through hole 407 and the supporting stub 324 into the through hole 408, the control lever 380 and the manipulating part 382 are so supported as to be capable of turning around the shaft 322 and shiftable to its first position, second position, third position and fourth position to be described in more detail afterwards.

A through hole 390 is formed in the front arm part 384. The through hole 390 is formed in a position in which the fixing stub 316 is snapped in a state wherein the control lever 380 is arranged in its third position to be described in more detail afterwards. As a result, the control lever 380 is fixed in its third position relative to the container body 306 by the through hole 390 and the fixing stub 316.

On the front arm part 384, a protective stub 392 is so formed as to be positioned over the gear 370. The protective stub 392 not only protects the tooth-formed face of the gear 370, but also makes it impossible for the operator to touch the gear 370 in a state in which the holding container 300 is mounted in the image forming device body 20.

Further, a guide stub 394 is formed toward the lower end of the front arm part 384 and toward the tip in the direction of inserting the holding container 300 into the image forming device body 20. The guide stub 394 is snapped into a guide groove 46 formed in the image forming device body 20 (see FIG. 21) and guides the engagement and disengagement of the holding container 300 into and out of the image forming device body 20.

Also, a collision restraining stub 396 is formed, in a state of being continuous from the guide stub 394 for instance, toward the lower end of the front arm part 384 and toward the tip in the direction of inserting the holding container 300 into the image forming device body 20. The collision restraining stub 396 makes it difficult for the tooth-formed face of the gear 370 to collide against the image forming device body 20 when the holding container 300 is inserted into the image forming device body 20. In addition, like the collision restraining stub 396, the guide stub 394 also has a function to make it difficult for the tooth-formed face of the gear 370 to collide against the image forming device body 20.

Toward the lower end of the rear arm part 386, a guide stub 402 is formed similarly to the guide stub 394 on the front arm part 384. The guide stub 402 is snapped into a guide groove 44 formed toward the image forming device body 20 (see FIG. 21) and guides the engagement and disengagement of the holding container 300 into and out of the image forming device body 20.

The control lever 380 and the manipulating part 382 are linked to the opening/closing member 352. Thus, the part of the front arm part 384 toward its lower end is linked to the front part of the opening/closing member 352, and the part of the rear arm part 386 toward its lower end is linked to the rear part of the opening/closing member 352. As a result, the opening/closing member 352 shifts, interlocked with the shift of the manipulating part 382 of the control lever 380. Details of the linking between the control lever 380 and the manipulating part 382 on one hand and the opening/closing member 352 on the other, such as the timing and way of linking of the control lever 380 and the manipulating part 382 to the opening/closing member 352, will be described afterwards.

The gear 370, mounted on the front face of the container body 306, is linked to and receives drive transmission from another gear (not shown) disposed on the image forming device body 20 side, when the holding container 300 is mounted into the image forming device body 20. Also, as described earlier, snapping of the shaft part 372 of the gear 370 into the snap-in recess 332*c* formed in the rotation shaft 332 of the mixing device 330 causes the gear 370 and the mixing device 330 to be linked to each other. As a result, when drive is transmitted and the gear 370 turns, the mixing device 330 turns within the container body 306, and the toner held in the container body 306 is mixed and carried.

The holding container 300 has not only the container body 306, the opening/closing part 350, the control lever 380 and the gear 370 but also the lid member 340 used as a sealing part for sealing the replenishing hole 314. The lid member 340 is mounted onto the container body 306 by being snapped into the replenishing hole 314 after the container body 306 is filled with toner via the replenishing hole 314. When the lid member 340 is mounted, the replenishing hole 314 is sealed and, irrespective of the direction of the container body 306, toner is prevented from spilling out of the replenishing hole 314.

Also, the holding container 300 has a covering member 342. The covering member 342 is so fitted to the container body 306 as to cover from outside the lid member 340 mounted on the container body 306. The presence of the covering member 342 prevents, even if the lid member 340 is about to come off the replenishing hole 314, the lid member 340 from completely coming off the replenishing hole 314, and thereby restrains the spreading around of toner having spilt out of the container body 306 through the replenishing hole 314.

Figure 8:
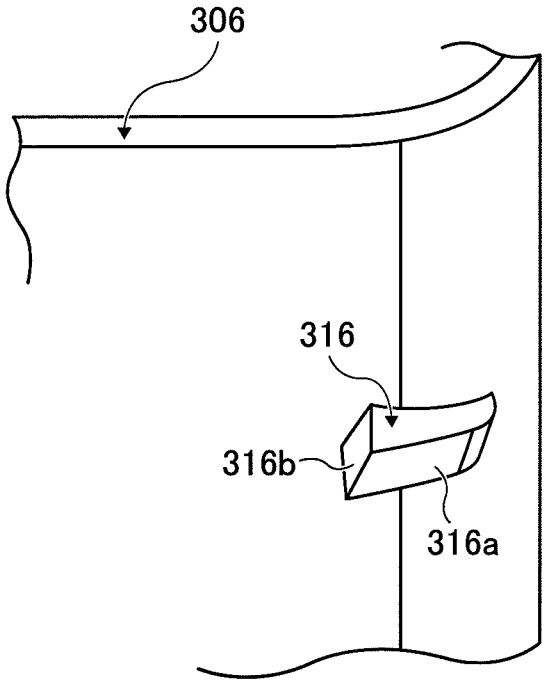
FIG. 8 is a perspective view showing part of the holding container pertaining to the exemplary embodiment of the present invention on an enlarged scale.

FIG. 8 shows on an enlarged scale the part in which the fixing stub 316 of the container body 306 is formed. As shown in FIG. 8, the fixing stub 316 has an inclined face 316*a* so formed as to be lower on the right side and higher on the left side and a perpendicular face 316*b* positioned to the left of the inclined face 316*a* and substantially perpendicular to the front face of the container body 306.

Figure 9:
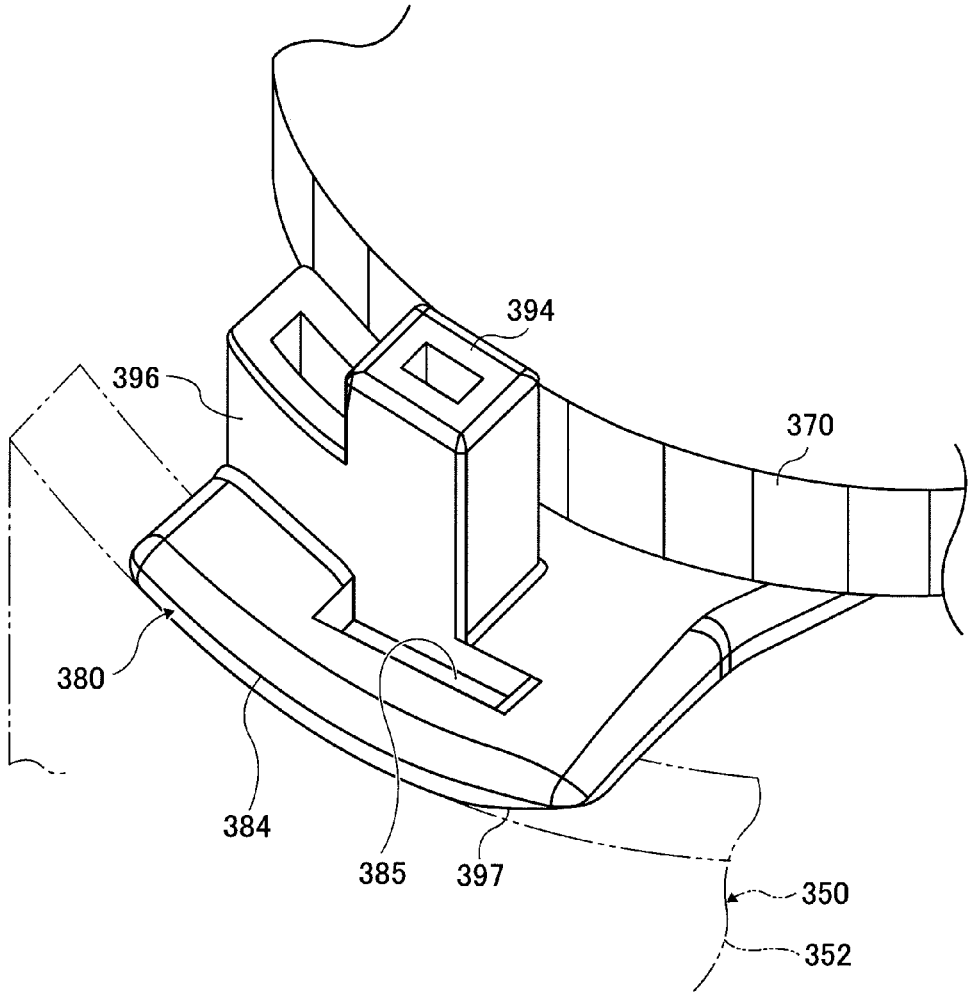
FIG. 9 is a perspective view showing part of a control lever of the holding container pertaining to the exemplary embodiment of the present invention on an enlarged scale.

FIG. 9 shows on an enlarged scale a part of the control lever 380 in a state in which the lever is released from linkage with the opening/closing part 350. As stated above, on the front arm part 384 of the control lever 380, the guide stub 394 and the collision restraining stub 396 are so formed as to protrude forward. In a position of the control lever 380, for instance the position adjoining the guide stub 394, a linking through hole 385 is formed. The linking through hole 385 is used for linking the control lever 380 and the opening/closing part 350.

Further, an inclined face 397 is formed toward the right end on the bottom part of the rear face (the face opposite the opening/closing part 350) of the front arm part 384. The inclined face 397 is so formed as to separate the right end part of the front arm part 384 and the opening/closing part 350 from each other and to shorten the distance between the front arm part 384 and the opening/closing part 350 toward the central part of the front arm part 384.

Figure 10:
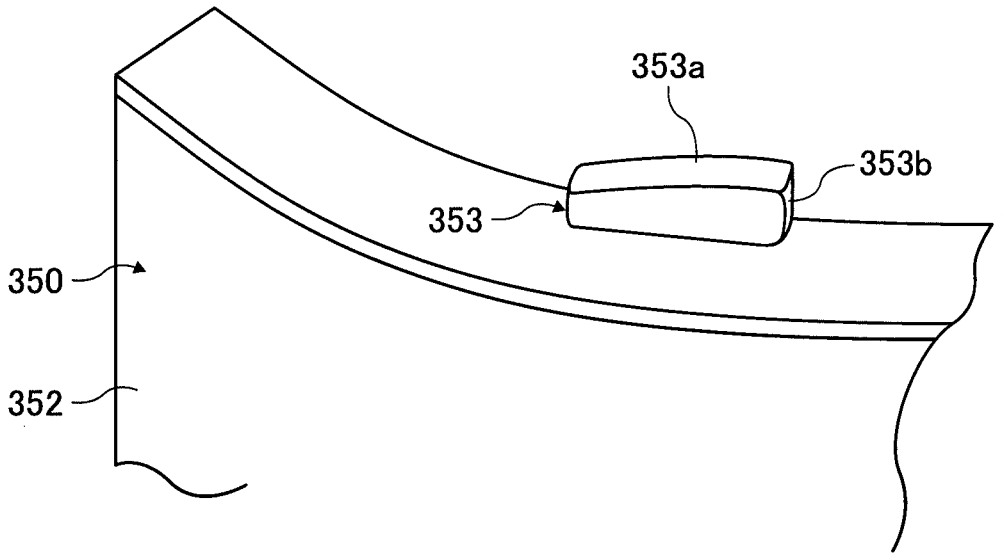
FIG. 10 is a perspective view of part of an opening/closing member of the holding container pertaining to the exemplary embodiment of the present invention on an enlarged scale.

FIG. 10 shows on an enlarged scale a part of the opening/closing member 352 of the opening/closing part 350.

On the front face of the opening/closing member 352, a linking stub 353 is so formed as to protrude forward. The linking stub 353 has an inclined face 353*a* so formed as to be higher on the right side and lower on the left side and a perpendicular face 353*b* positioned to the right of the inclined face 353*a* and substantially perpendicular to the front face of the opening/closing member 352.

FIGS. 11A to 12C illustrate how the control lever 380 moves.

Figures 11A, 11B, 11C, 11D:
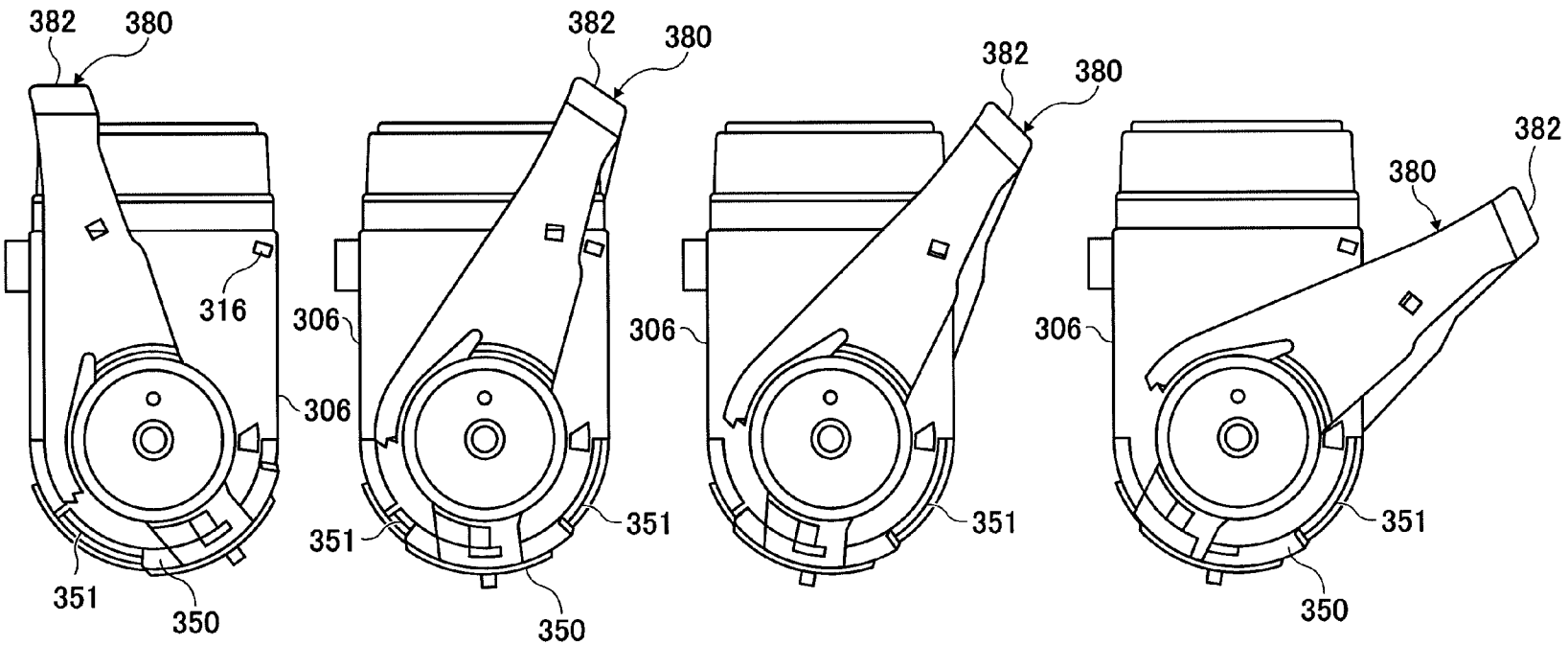
Figure 12A:
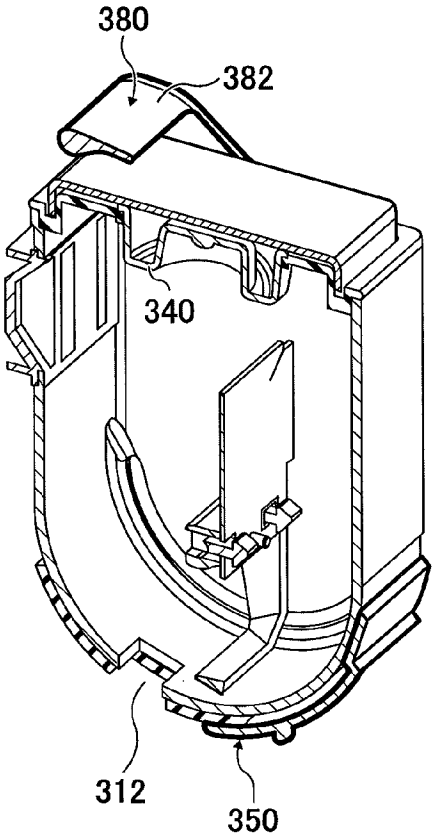
Figure 12B:
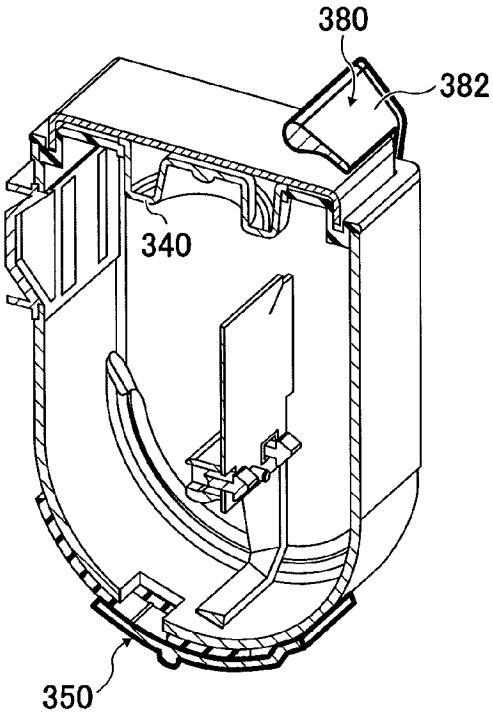
Figure 12C:
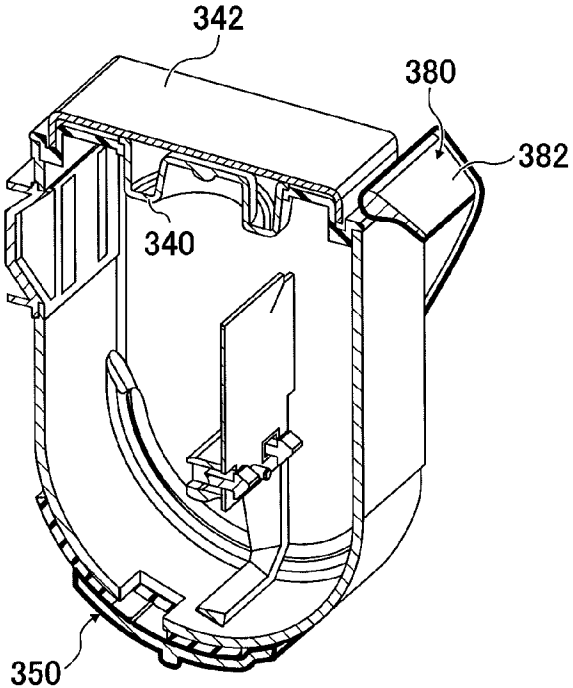

The control lever 380 and the manipulating part 382 can move to and from a first position shown in FIG. 11A and FIG. 12A, a second position shown in FIG. 11B and FIG. 12B, a third position shown in FIG. 11C and FIG. 12C, and a fourth position shown in FIG. 11D.

The first position shown in FIG. 11A and FIG. 12A is a position in which the ejection hole 312 formed in the container body 306 is opened. It is known as an open position. Thus, when the control lever 380 and the manipulating part 382 are in the first position, the opening/closing part 350 linked to the control lever 380 is arranged in a position distant from the ejection hole 312. When mounted in the image forming device body 20 to supply toner to the developing device 110, the control lever 380 and the manipulating part 382 are so manipulated as to be placed in the first position. In the state in which they are placed in the first position, the manipulating part 382 is placed in a position to overlap the container body 306 in the up-and-down direction in which the mixing device 330 is fitted to the container body 306.

The second position shown in FIG. 11B and FIG. 12B is a position in which the ejection hole 312 is placed in a closed state. It is known as a sealed position. The second position is a position in which the manipulating part 382 of the control lever 380 is placed in a position to overlap the container body 306 in the direction in which the lid member 340 is fitted to the container body 306 (the up-and-down direction in this exemplary embodiment). When the control lever 380 is in the second position, the opening/closing part 350 linked to the control lever 380 goes into a state of being placed in a position of covering the ejection hole 312, which is placed in a blocked state. Further in the state of being placed in the second position, the manipulating part 382 is placed in a position to overlap the container body in the up-and-down direction in which the mixing device 330 is fitted to the container body 306.

The third position shown in FIG. 11C and FIG. 12C is a position in which the ejection hole 312 is placed in a closed state and the control lever 380 and the manipulating part 382 are placed when the container body 306 is filled with toner. It is known as a filling position. The third position is a position in which the manipulating part 382 of the control lever 380 is placed in a position not to overlap the container body 306 in the direction in which the lid member 340 is fitted to the container body 306 (the up-and-down direction in this exemplary embodiment). When the control lever 380 and the manipulating part 382 are in the third position, the opening/closing part 350 linked to the control lever 380 goes into a state of being placed in a position of covering the ejection hole 312, which is placed in a blocked state. Since the control lever 380 and the opening/closing part 350 are linked to each other, when the control lever 380 is shifted from the second position to the third position, the opening/closing part 350 also shifts along with the shifting of the control lever 380; however, since the ejection hole 312 is formed greater than the size of the opening/closing part 350, the opening/closing part 350 shifts with the ejection hole 312 kept in the closed state, namely with the sealing member 354 of the opening/closing part 350 remaining in the state of sealing the ejection hole 312. Further, when the control lever 380 is in the third position, the manipulating part 382 takes on a state of not overlapping the container body 306 in the up-and-down direction, namely the direction in which the lid member 340 is fitted to the container body 306.

If it is attempted to mount the holding container 300 into the image forming device body 20 when the control lever 380 and the manipulating part 382 are in the third position, the control lever 380 and the image forming device body 20 will interfere with each other. Thus, the control lever 380 is used as an interfering part that interferes with the image forming device body 20 when it is attempted to mount the holding container 300 into the image forming device body 20 in a state in which the control lever 380 is in the third position.

Further, with the control lever 380 being in the third position, it is difficult for the manipulating part 382 to obstruct the shifting (fall) of toner when the container body 306 is to be filled with toner. Also, it is difficult for the control lever 380 in the third position to obstruct positioning of the lid member 340 and its fitting to the container body 306 by plugging in or otherwise, and therefore fitting of the lid member 340 to the container body 306 is facilitated. Further, it is difficult for the control lever 380 in the third position to obstruct positioning of the covering member 342 and its fitting to the container body 306 in the direction in which the lid member 340 is fitted to the container body 306 (the up-and-down direction in this exemplary embodiment), and fitting of the covering member 342 to the container body 306 is therefore facilitated. In a state in which the control lever 380 is placed in the third position, after filling the container body 306 with toner, the replenishing hole 314 of the container body 306 is closed with the lid member 340, and the covering member 342 is so fitted to the container body 306 as to cover the lid member 340.

The fourth position shown in FIG. 11D is the position at the point of time when the control lever 380 is fitted to the container body 306. Or, the fourth position may as well be a position matching the position at the time of fitting the container body 306 to the mixing device 330 (see FIG. 6). In the state in which the control lever 380 is placed in the fourth position, in the up-and-down direction in which the mixing device 330 is fitted to the container body 306, the manipulating part 382 goes into a position not to overlap the container body 306. For this reason, it is more difficult for the manipulating part 382 to obstruct fitting of the mixing device 330 to the container body 306 than when the manipulating part 382 is placed in a position to overlap the container body 306 in the up-and-down direction. Thus, when the control lever 380 and the manipulating part 382 are in the fourth position, it is more difficult for the manipulating part 382 to obstruct fitting of the mixing device 330 into the container body 306 than when the control lever 380 and the manipulating part 382 are in any of the first, second and third positions.

The control lever 380, if it has not moved from the fourth position to any other position after it is fitted to the container body 306, it is in a state of not being linked to the opening/closing part 350. When a holding container 300 is assembled and the holding container 300 is filled with toner, after fitting the mixing device 330 to the container body 306 in a state in which the control lever 380 and the manipulating part 382 are placed in the fourth position, the control lever 380 and the manipulating part 382 are shifted to the third position and the container body 306 is filled with toner.

To add, as shown in FIGS. 11A and 11B, an opening/closing part guide groove 351 for use in guiding the shifting of the opening/closing part 350 relative to the container body 306 is formed in the container body 306. The opening/closing part guide groove 351 is so provided as to be capable of extending, when the opening/closing part 350 is in the second position, in one or the other of both opening and closing directions of the opening/closing part 350; namely, it can extend not only in the opening direction but also in the closing direction of the opening/closing part 350. When the opening/closing part 350 shifted between the second position and the third position, the opening/closing part 350 is guided into the opening/closing part guide groove 351 with the sealing member 354 of the opening/closing part 350 keeping the ejection hole 312 sealed.

Figure 13B:
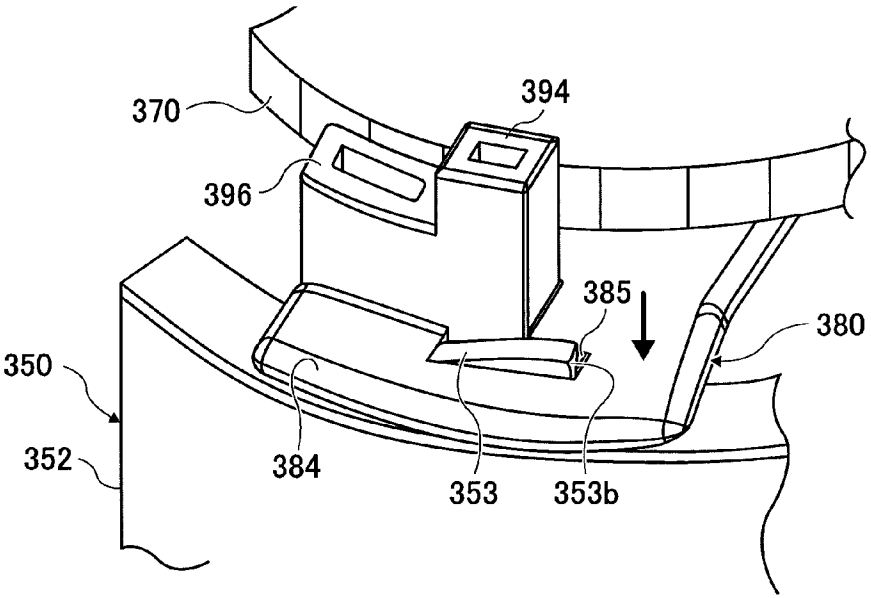
Figure 13A:
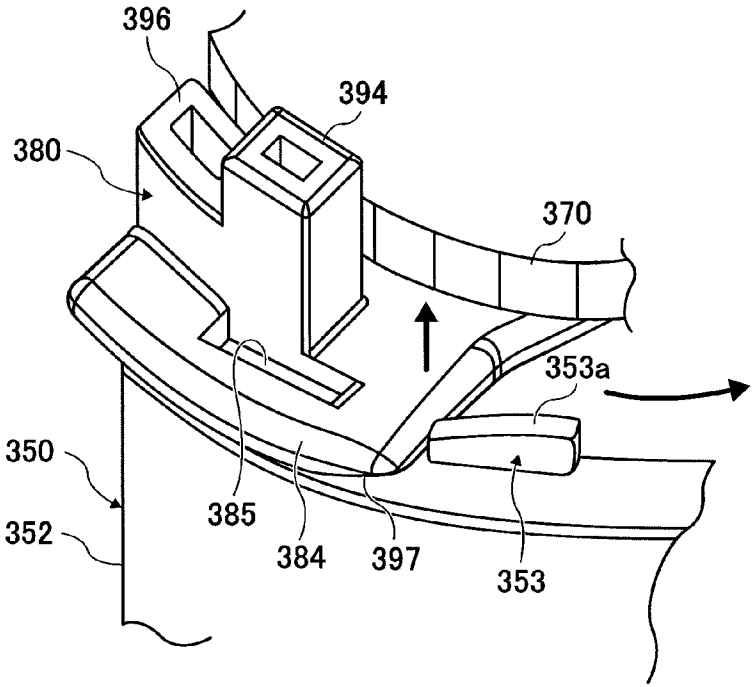

FIGS. 13A and 13B illustrate how the control lever 380 and the manipulating part 382 operate relative to each other when they shift from the fourth position to the third position. As stated above, in the state in which the control lever 380 and the manipulating part 382 are placed in the fourth position, the control lever 380 and the opening/closing part 350 are not linked to each other. The control lever 380 and the opening/closing part 350 are linked to each other interlocked with the shifting of the control lever 380 and the manipulating part 382 from the fourth position to the third position.

Thus, as shown in FIG. 13A, the portion of the front arm part 384 in which the inclined face 397 is formed comes into contact with the linking stub 353 formed on the opening/closing member 352 on the way of the shifting of the control lever 380 from the fourth position to the third position. When the control lever 380 further shifts in a manner of turning toward the third position, the inclined face 397 of the front arm part 384 is elastically deformed in a manner of riding over the inclined face 353*a* of the linking stub 353. Shifting of the control lever 380 farther toward the third position causes the linking stub 353 to be snapped into the linking through hole 385 as shown in FIG. 13B, and the control lever 380 and the opening/closing part 350 are linked to each other.

Although the control lever 380 and the opening/closing part 350 are linked to each other interlocked with the shifting of the control lever 380 from the fourth position to the third position as stated above, even if the control lever 380 is shifted from the third position to the fourth position, the control lever 380 and the opening/closing part 350 will not be released from the linkage. This is due to the circumstance that, as shown in FIG. 13*b*, though an end of the linking through hole 385 abuts with the perpendicular face 353*b* of the linking stub 353 when it is attempted to shift the control lever 380 toward the fourth position, the front arm part 384 is not so elastically deformed as to release the linking stub 353 and the linking through hole 385 from their mutual engagement.

Figure 14B:
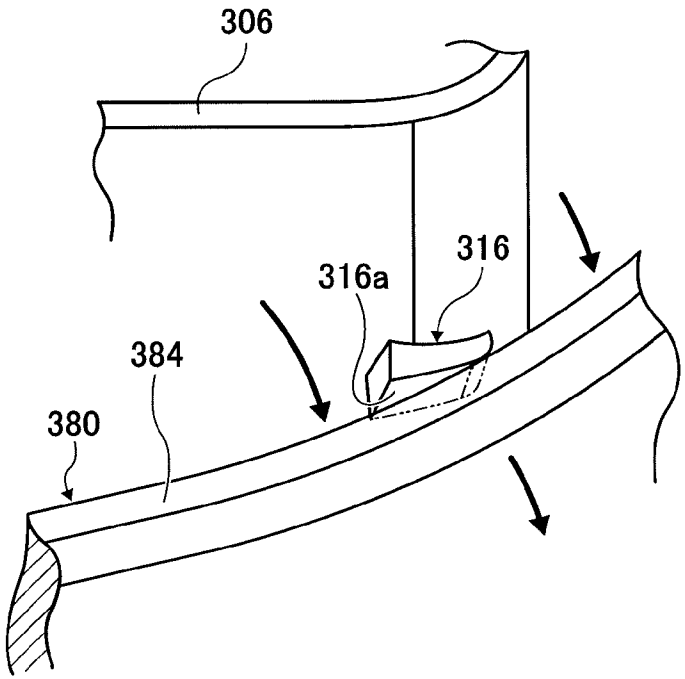
Figure 14A:
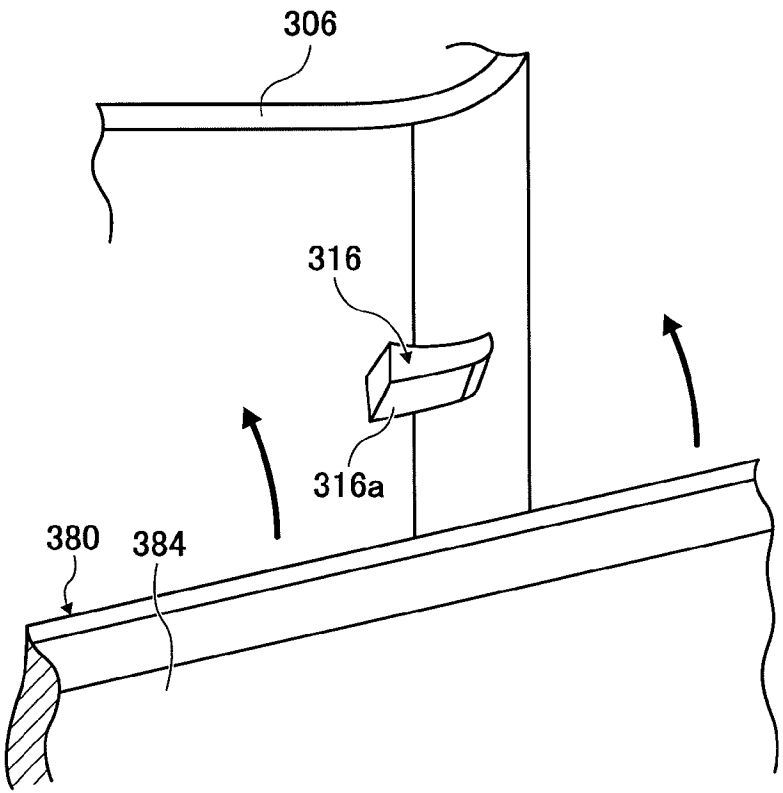

FIGS. 14A and 14B illustrate how the control lever 380 operates when the control lever 380 and the manipulating part 382 shift from the fourth position to the third position.

As shown in FIG. 14A, the front arm part 384 comes into contact with the fixing stub 316 formed on the container body 306 on the way of the shifting of the control lever 380 from the fourth position to the third position. When the control lever 380 further shifts in the manner of turning toward the third position as shown in FIG. 14B, the front arm part 384 is elastically deformed in the manner of riding over the inclined face 353*a* of the fixing stub 316. Shifting of the control lever 380 farther to reach the third position causes the fixing stub 316 to be snapped into the through hole 390 formed in the front arm part 384 (see FIG. 3), and the control lever 380 is fixed in the third position relative to the container body 306.

Although the shifting of the control lever 380 from the fourth position to the third position is permitted as stated above, the shifting of the control lever 380 from the third position to the fourth position is forbidden. This is because, even if it is attempted to shift the control lever 380 toward the fourth position, the front arm part 384 will not be elastically deformed and the state in which the fixing stub 316 is snapped into the through hole 390 is maintained.

Figure 15:
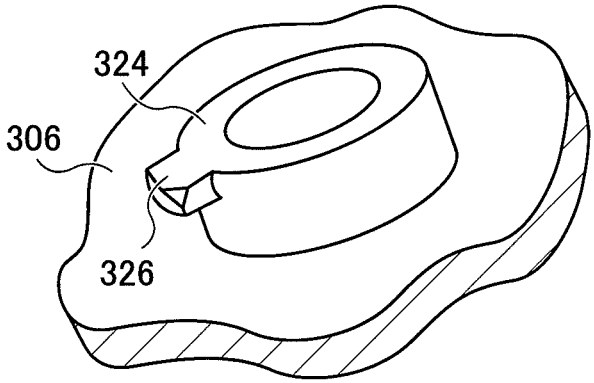
FIG. 15 is a perspective view of a stub formed on the body of the holding container pertaining to the exemplary embodiment of the present invention to rotatably support the control lever.

FIG. 15 shows the supporting stub 324 (see FIG. 4).

The supporting stub 324, as stated above, is formed on the rear face of the container body 306, has a substantially columnar shape, is inserted into the through hole 408 formed in the rear arm part 386 of the control lever 380, and supports the control lever 380 to be rotatable relative to the container body 306.

In a position that is part of the supporting stub 324 in the circumferential direction and distant from the front face of the container body 306, a protrusive part 326 protruding in the circumferential direction is disposed.

Figure 16:
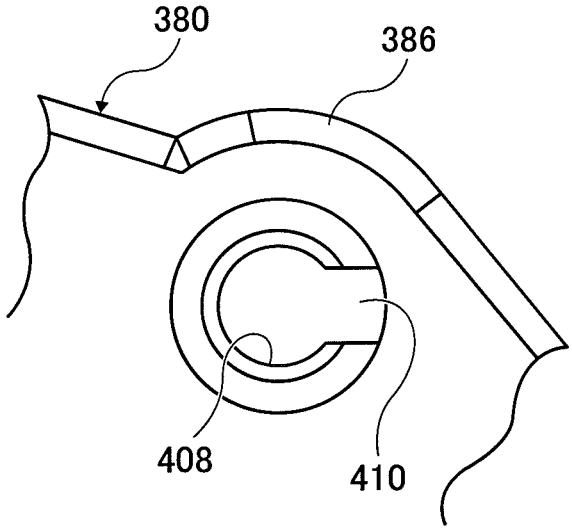
FIG. 16 is a profile showing the shape of a through hole formed in the control lever of the holding container pertaining to the exemplary embodiment of the present invention.
Figure 17:
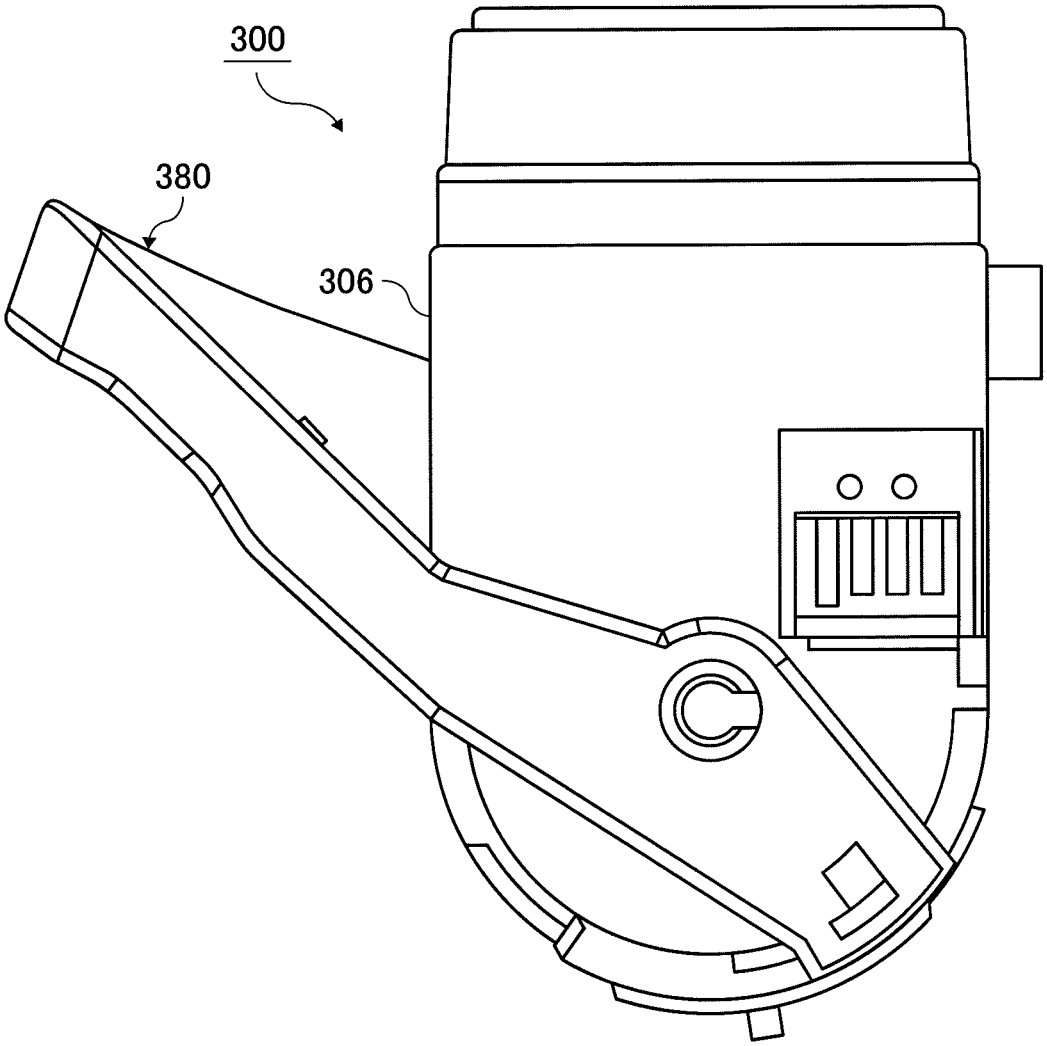
FIG. 17 is a rear view showing a state in which the control lever of the image forming device pertaining to the exemplary embodiment of the present invention is arranged in its fourth position.

FIG. 16 shows on an enlarged scale a part of the rear arm part 386 the control lever 380 in which the through hole 408 is formed, and FIG. 17 shows a holding container 300 in a state in which the control lever 380 is placed in the fourth position.

As shown in FIG. 16, in a portion of the through hole 408 in the circumferential direction, a larger bore part 410 is formed to make the bore of the hole greater there than elsewhere. The larger bore part 410 is so formed as to let the protrusive part 326 of the supporting stub 324 be snapped in when the supporting stub 324 is to be inserted into the through hole 408. For this reason, the control lever 380 can be mounted onto the container body 306 only when the larger bore part 410 is in a positional relationship that allows the lever to enter the protrusive part 326. The position of the control lever 380 and the manipulating part 382 that allows mounting onto the container body 306 is the fourth position shown in FIG. 17 (see FIG. 11D). Thus, the control lever 380 goes into a state of being placed in the fourth position at the point of time when it is mounted onto the container body 306.

Figure 18B:
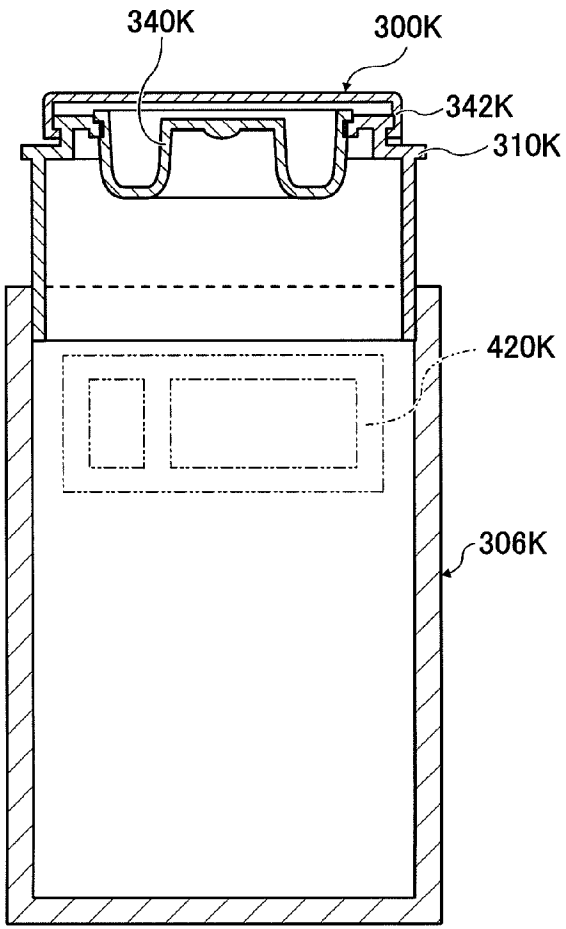
FIG. 18B is a sectional view schematically showing a holding container pertaining to the exemplary embodiment of the present invention, which is a holding container used for holding black toner.
Figure 18A:
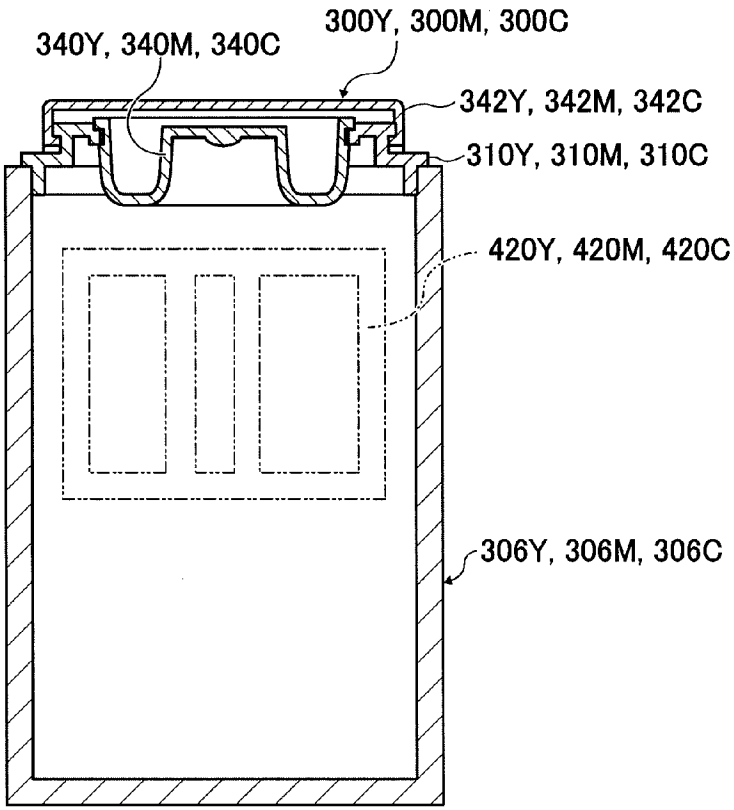
FIG. 18A is a sectional view schematically showing holding containers pertaining to the exemplary embodiment of the present invention, which are holding containers used for holding yellow toner, magenta toner and cyan toner.

FIG. 18A shows a sectional view of the holding containers 300Y, 300M and 300C, and FIG. 18B shows a sectional view of the holding container 300K. As stated above, the holding container 300K is greater in capacity than the holding containers 300Y, 300M and 300C.

As shown in FIG. 18A and FIG. 18B, upper sub-containers 310Y, 310M, 310C and 310K having a volume regulating function are fitted to container bodies 306Y, 306M, 306C and 306K. The upper sub-containers 310Y, 310M, 310C and 310K, being used as fitting members fitted to the container bodies 306Y, 306M, 306C and 306K, are fitted by ultrasonic welding, for instance, to the container bodies 306Y, 306M, 306C and 306K. Neither the size nor the shape of the container bodies 306Y, 306M, 306C and 306K varies with the toner color, yellow, magenta, cyan or black. For this reason, common parts are used for yellow, magenta, cyan and black toners.

The size of the upper sub-container 310 is greater for the upper sub-container 310K for black toner than for that of the upper sub-containers 310Y, 310M and 310C for yellow, magenta and cyan toners, respectively. The upper sub-container 310K for black toner can hold toner inside in the state of being fitted to the container body 306K.

Also, the size of distinguishing members 420Y, 420M and 420C is greater that of a distinguishing member 420K. This difference in size makes the height of the bottom ends of the distinguishing members 420Y, 420M and 420C and that of the bottom end of the distinguishing member 420K the same when the holding containers 300Y, 300M, 300C and 300K are so mounted in the image forming device body 20 as to make the height of the top ends of the holding containers 300Y, 300M and 300C the same as that of the top end of the holding container 300K.

Figure 19:
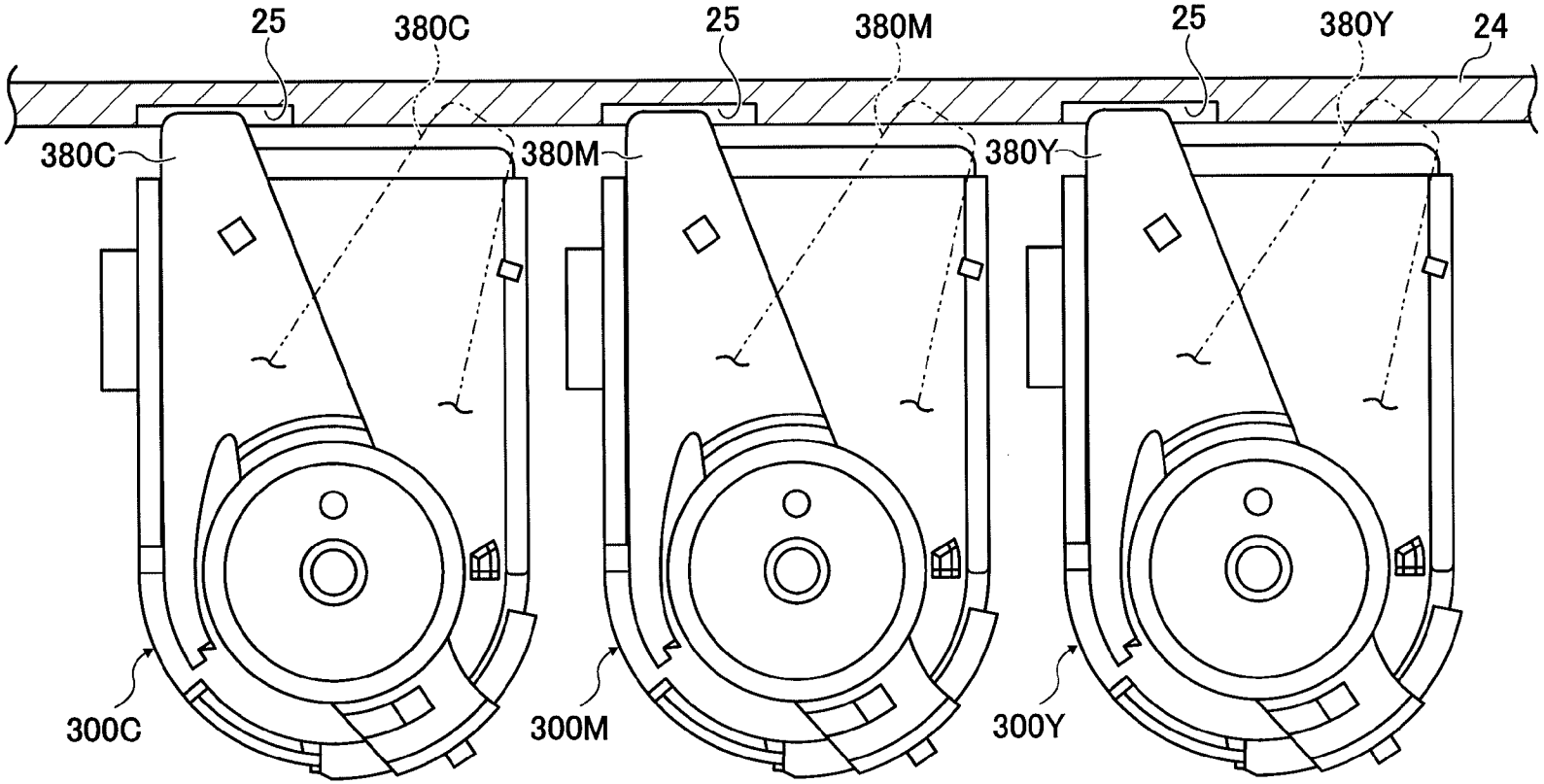
FIG. 19 is a sectional view showing the shape of the opening/closing part for mounting use in the image forming device pertaining to the exemplary embodiment of the present invention.

FIG. 19 shows a section of the opening/closing part 24 for mounting use in its state of being close relative to the image forming device body 20.

In the opening/closing part 24 for mounting use, four concaves 25 (three of which are shown in FIG. 19) corresponding to the number of holding containers 300 to be mounted in the image forming device body 20 are formed. The four concaves 25 are so formed as to let the upper end part of the control lever 380 placed in the first position of each holding container 300 mounted in the image forming device body 20 enter one or another of them. On the other hand, when the control lever 380 is placed in the second position as represented by two-dot chain lines in FIG. 19, the upper end part of each control lever 380 and the opening/closing part 24 for mounting use interfere with each other. Thus, unless the control lever 380 of every holding container 300 mounted in the image forming device body is placed in the first position, the opening/closing part 24 for mounting use cannot be closed relative to the image forming device body 20.

As a result, at the time each holding container 300 is mounted in the image forming device body 20, it is ensured that the action to shift the control lever 380 to the first position is accomplished, the ejection hole 312 formed in the holding container 300 is opened, and toner is supplied from the holding container 300 to the developing device 110. To add, it is also possible to provide an opening/closing sensor for detecting the opening/closing of the opening/closing part 24 for mounting use and, when the opening/closing sensor has detected the opening state of the opening/closing part 24 for mounting use, to indicate an alarm on the control panel 12 or forbid imaging action, for instance.

Figure 20:
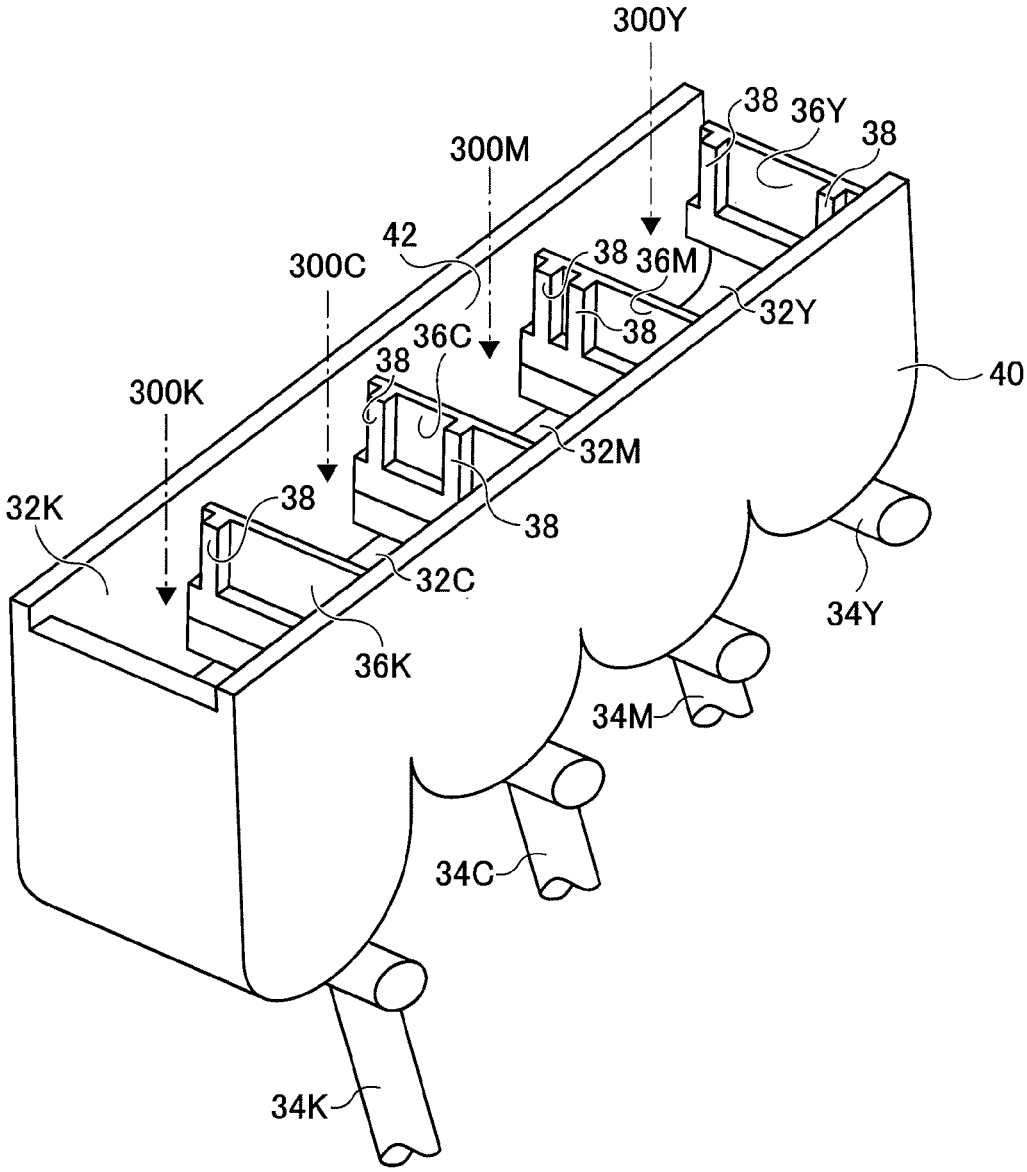
FIG. 20 is a first perspective view of a mounting part formed in the device body of the image forming device pertaining to the exemplary embodiment of the present invention, into which holding containers are mounted.

FIG. 20 shows a perspective view of the mounting device 30.

As shown in FIG. 20, the mounting device 30 has a right side plate 40, a left side plate 42, and connecting plates 36Y, 36M, 36C and 36K to link the right side plate 40 and the left side plate 42, and these members form the mounting chambers 32Y, 32M, 32C and 32K each open in the top part. The holding containers 300Y, 300M, 300C and 300K are mounted from above into the mounting chambers 32Y, 32M, 32C and 32K, respectively.

Toner carriage paths 34Y, 34M, 34C and 34K are fitted underneath the mounting chambers 32Y, 32M, 32C and 32K, respectively. The toner carriage paths 34Y, 34M, 34C and 34K are used for carrying toners in the holding containers 300Y, 300M, 300C and 300K to the developing devices 110Y, 110M, 110C and 110K, respectively.

Each of the connecting plates 36Y, 36M, 36C and 36K is used as a body side distinguishing device, and one or more convexes 38 are so formed on each connecting plate as to differ in at least one factor out of the number, position and width from others.

Each of the convexes 38 is formed in a position to be snapped into the concave 424 (see FIG. 4) provided into the holding container 300 to be mounted in the corresponding mounting chamber 32 and in a size suitable for the snapping-in. For instance, on the mounting chamber 32Y, a convex 38 is so formed as to be snapped into the concave 424 formed in the yellow toner holding container 300Y to be mounted in the mounting chamber 32Y. As stated earlier, the position of the concave 424 formed on the holding container 300 differs with the type, for instance color, of the toner held in holding container 300. For this reason, although the right holding container 300 to be mounted in any specific mounting chamber 32 can be mounted in that mounting chamber 32, even if an attempt is made to mount in a mounting chamber 32 any holding container 300 holding a different toner from what should correctly be held in that mounting chamber 32, the convex 422 of the holding container 300 and the convex 38 of the distinguishing member 420 will interfere with each other to prevent the holding container 300 from being mounted in that mounting chamber 32.

Figure 21:
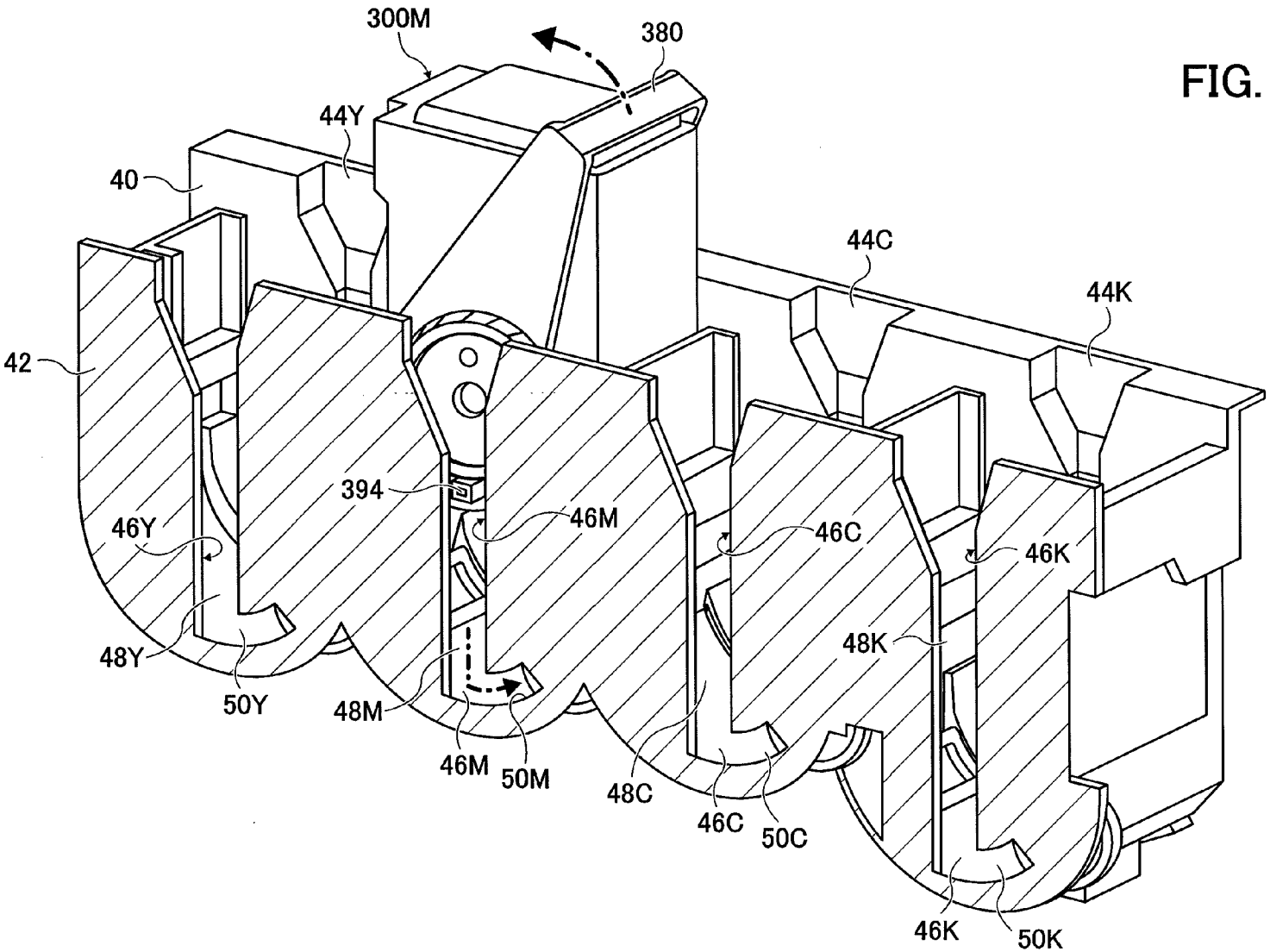
FIG. 21 is a second perspective view of the mounting part formed in the device body of the image forming device pertaining to the exemplary embodiment of the present invention, into which holding containers are mounted.

FIG. 21 shows a sectional view of the mounting device 30.

As shown in FIG. 21, on the right side plate 40 of the mounting device 30, four guide grooves 44Y, 44M, 44C and 44K are formed. When the holding containers 300Y, 300M, 300C and 330K are to be mounted into the mounting chambers 32Y, 32M, 32C and 32K, the guide stubs 402 (see FIG. 4) take on a state of being snapped into the guide grooves 44Y, 44M, 44C and 44K and guide the mounting of the holding containers 300Y, 330M, 300C and 300K.

In the left side plate 42, four guide grooves 46Y, 46M, 46C and 46K are formed. When the holding containers 300Y, 300M, 300C and 330K are to be mounted into the mounting chambers 32Y, 32M, 32C and 32K, the guide stubs 394 (see FIG. 3) take on a state of being snapped into the guide grooves 46Y, 46M, 46C and 46K, and guide the mounting of the holding containers 300Y, 330M, 300C and 300K into the respective mounting chambers 32. Each of the guide grooves 44 has a mounting direction guiding part 48 that is wider at the entrance, gradually narrows in the mounting direction of the holding container 300 and afterwards takes on the same width and an arciform part 50 extending in a substantially arciform shape from the farther end of the mounting direction guiding part 48. When the control lever 380 is so manipulated as to shift the holding container 300, after it is mounted in the mounting chamber 32, to the first position, the guide stub 402 enters the arciform part 50.

Each of the arciform parts 50 is used as a removal forbidding unit to forbid the holding container 300 from being removed out of the image forming device body 20 in a state in which the control lever 380 is placed in the first position. In the state in which the control lever 380 is placed in the first position, the guide stub 394 enters the arciform part 50 and, even if it is tried to lift the holding container 300 to take it out, the guide stub 394 will interfere with the part of the left side plate 42 constituting the arciform part 50, making it impossible to remove the holding container 300 from the image forming device body 20.

Figure 22B:
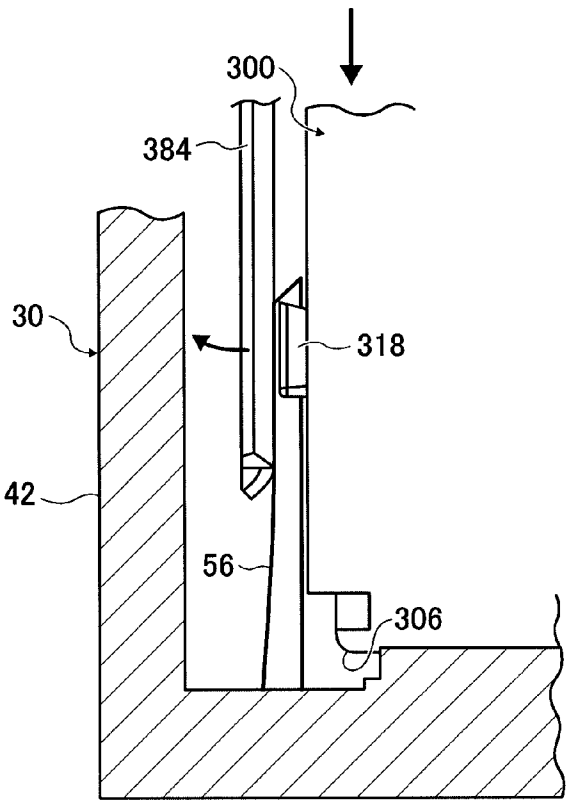
Figure 22A:
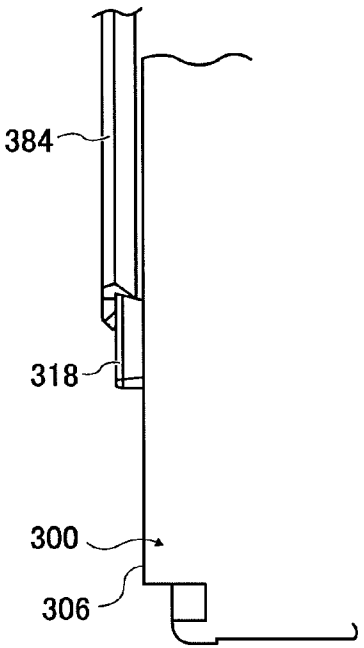

FIGS. 22A and 22B illustrate how a holding container 300 is mounted into a mounting device 30, wherein FIG. 22A shows a right side profile of the holding container 300 in a state in which the control lever 380 is placed in the second position and FIG. 22B shows a right side profile of the holding container 300 and a sectional view of the mounting device 30.

As shown in FIG. 22A, when no holding container 300 is mounted in the image forming device body 20, the forbidding stub 318 (see also FIG. 5) is in a position to interfere with the locus of the shifting of the front arm part 384 of the control lever 380 in a state in which the control lever 380 is placed in the second position, making it impossible for the control lever 380 to shift from the second position to the first position.

Meanwhile, when a holding container 300 is inserted into the image forming device body 20, an insertion member 56 so disposed as to protrude upward from the bottom face of the mounting device 30 is inserted between the container body 306 and the front arm part 384 as shown in FIG. 22B, and the front arm part 384 is deformed in a direction away from the container body 306 and shifts to a position where it does not interfere with the forbidding stub 318. For this reason, when the holding container 300 is mounted into the image forming device body 20, it is made possible to shift the control lever 380 from the second position to the first position.

Figure 23:
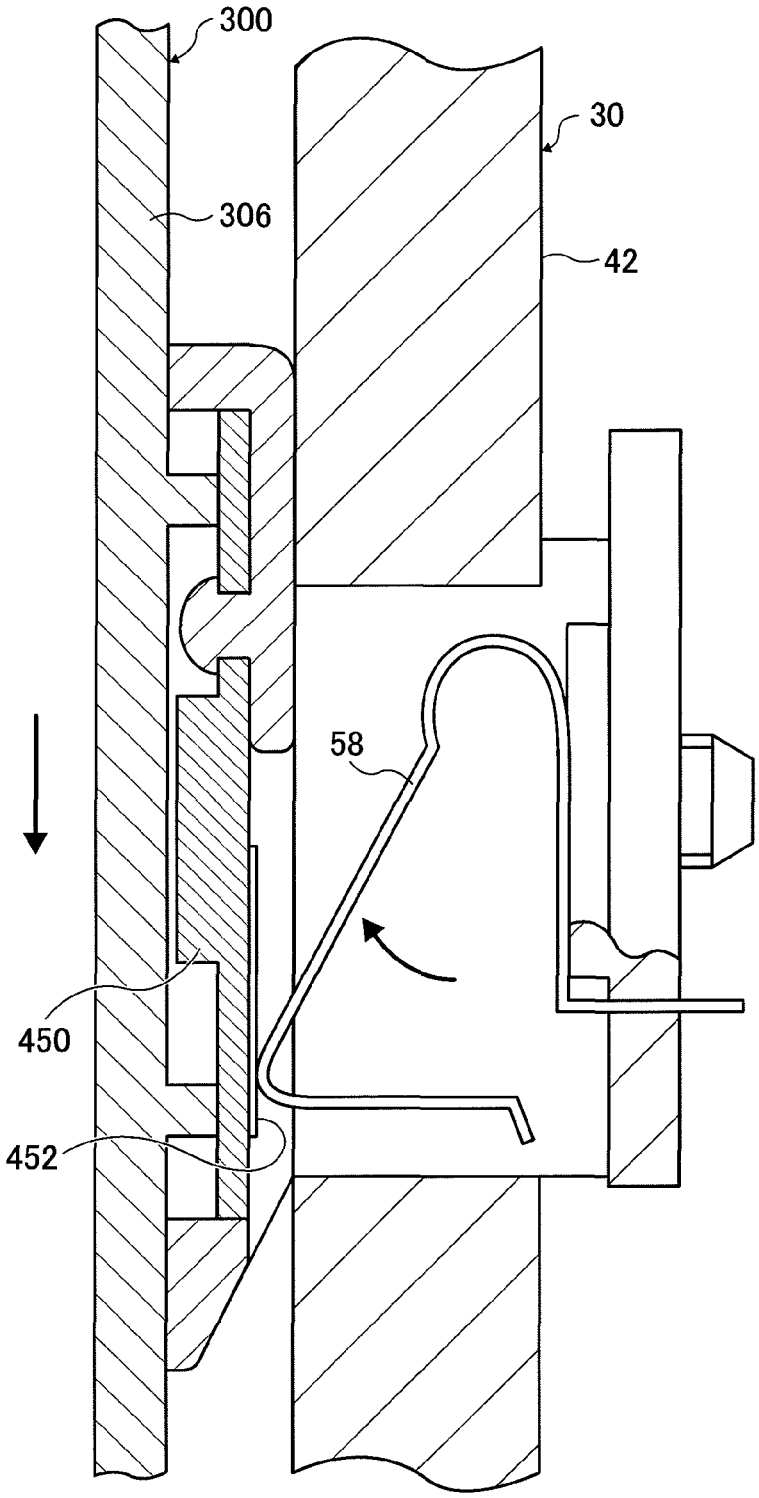
FIG. 23 is a sectional view illustrating the action to connect a storage member disposed in the holding container pertaining to the exemplary embodiment of the present invention and a connecting part formed in the image forming device body.

FIG. 23 shows a configuration in which, in a state of being mounted in the mounting device 30, the storage medium 450 mounted in the holding container 300 and the image forming device body 20 side are connected to each other. As shown in FIG. 23, a deformable electrode 58 is mounted on the right side plate 40 of the mounting device 30, and the image forming device body 20 side and the storage medium 450 are connected to each other as the electrode 58 is pressed against the electrode 452 of the storage medium 450.

Figure 24:
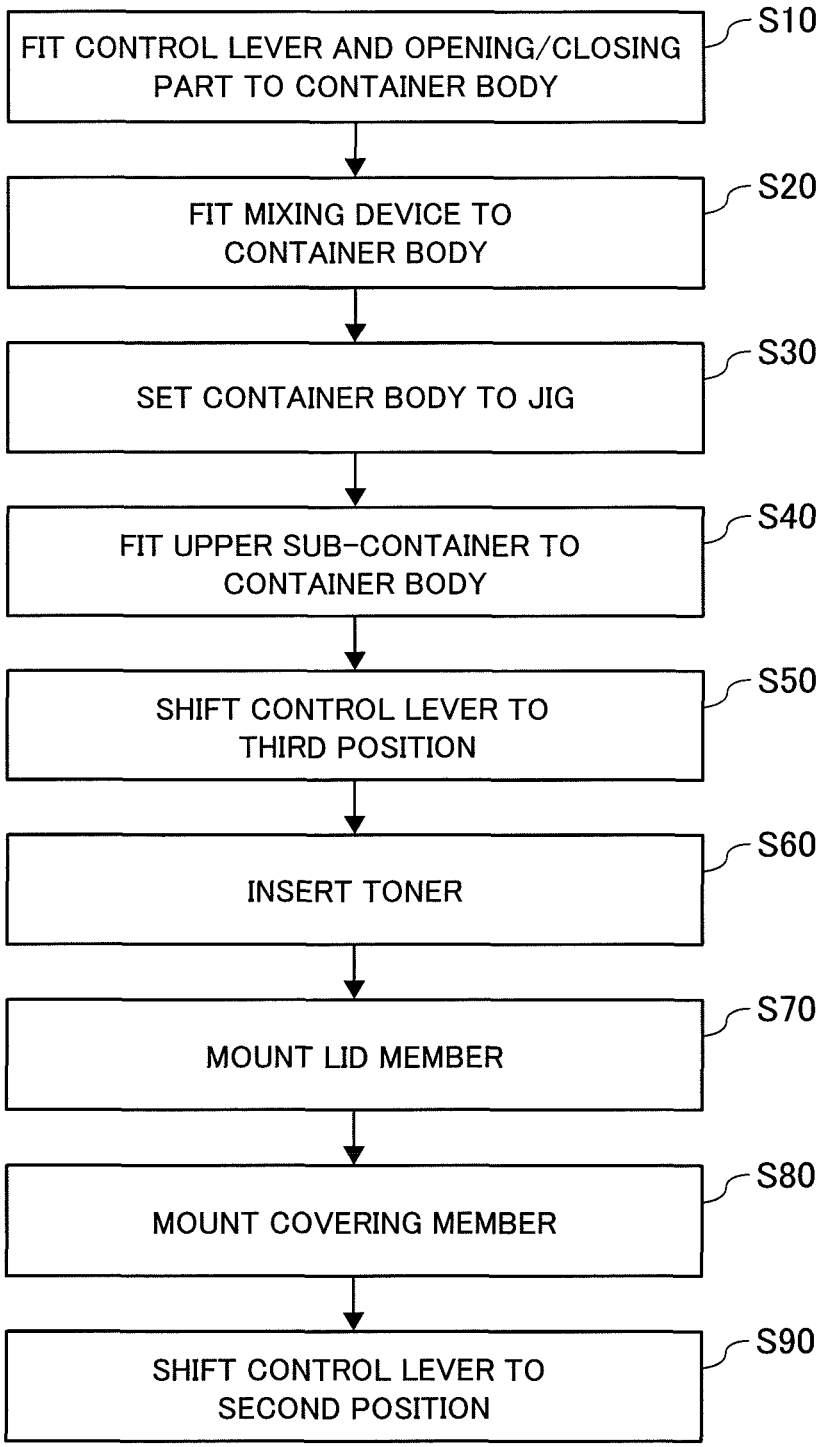
FIG. 24 charts the flow of a process in which a holding container pertaining to the exemplary embodiment of the present invention is filled with toner.

FIG. 24 charts the flow of filling a holding container 300 with toner in the process of manufacturing for instance. As charted in FIG. 24, to fill the holding container 300 with toner, the control lever 380 and the opening/closing part 350 are fitted to the container body 306 at the first step S10. At this step, it is required for the protrusive part 326 protruding from the supporting stub 324 of the container body 306 to be snapped into the larger bore part 410 formed in the through hole 408 of the control lever 380, and the control lever 380 is so assembled to be placed in the fourth position relative to the container body 306. In addition at this step, the space between the front arm part 384 and the rear arm part 386 is expanded by elastically deforming the control lever 380, and the control lever 380 is fitted to the container body 306 in such a way that the container body 306 is squeezed between the front arm part 384 and the rear arm part 386. In this way, the control lever 380 is fitted in a direction different from that in which the control lever 380 rotates in a state of being fitted to the container body 306.

Further, the opening/closing part 350 is so assembled with the container body 306 as to snap the opening/closing part 350 into the opening/closing part guide groove 351. At the completion of step S10, the control lever 380 and the opening/closing part 350 are not yet linked to each other.

At next step S20, the mixing device 330 is fitted to the container body 306. At this point of time, as the manipulating part 382 is in the fourth position and the control lever 380 is in a position not to overlap the container body 306 in the direction of fitting the mixing device 330 to the container body 306, the control lever 380 can be fitted more easily than when the manipulating part 382 is in a position to overlap the container body 306 in the direction of fitting the mixing device 330 to the container body 306, resulting in enhanced efficiency of the assembling work to fit the control lever 380.

To add, the order of step S10 and step S20 may as well be reversed.

At next step S30, the container body 306 is so set to a jig (not shown) as to direct the replenishing hole 314 upward. At this step, the mixing device 330 is so adjusted as to make its longer dimension be directed up and down.

At next step S40, an upper sub-container 310 is fitted to the container body 306, and the upper sub-container 310 is fixed to the container body 306 by, for instance, ultrasonic welding. At this time, as the manipulating part 382 is in the fourth position and in a position not to overlap the container body 306 in the direction of fitting the upper sub-container 310 to the container body 306, the work of fitting the upper sub-container 310 is easier than when the manipulating part 382 is in a position to overlap the container body 306 in the direction of fitting the upper sub-container 310 to the container body 306, resulting in enhanced efficiency of the assembling work to fit the upper sub-container 310.

Instead of fitting the upper sub-container 310 to the container body 306 at step S40, the upper sub-container 310 may as well be fitted to the container body 306 in advance of step S10. Details of step S40 will be described afterwards.

At next step S50, the control lever 380 is shifted from the fourth position to the third position. By being shifted to the third position, the control lever 380 is so elastically deformed as to ride over the inclined face 316*a* of the fixing stub 316, and the lever is fixed in the third position as the fixing stub 316 enters the through hole 390. For this reason, the control lever 380 is prevented from moving when toner is to be inserted into the container body 306 at step S60 to be described afterwards, and it is made difficult for faulty insertion of toner to be invited by any movement of the control lever 380.

Further the shifting of the control lever 380 from the fourth position to the third position at step S50 causes the linking stub 353 formed on the opening/closing member 352 formed on the opening/closing part 350 to be snapped into the linking through hole 385 formed in the front arm part 384 of the control lever 380, thereby linking the control lever 380 and the opening/closing part 350 to each other.

At next step S60, toner is so inserted into the container body 306 as to be dropped from above via the replenishing hole 314. At this time, as the control lever 380 is in the third position and the manipulating part 382 of the control lever 380 is in a position not to overlap the replenishing hole 314 in the toner filling direction (up-and-down direction), the control lever 380 never obstructs the filling of toner.

Further, by so adjusting the longitudinal direction of the mixing device 330 as to coincide with the up-and-down direction, it is made difficult to obstruct falling of the toner in the container body 306 and the reaching of the toner to the bottom of the container body 306 is facilitated, resulting in the filling of toner without wasting the space in the container body 306.

At next step S70, the lid member 340 is so mounted into the replenishing hole 314 as being pressed downward from above, and the replenishing hole 314 is thereby sealed. At this time, as the control lever 380 is in the third position and the manipulating part 382 of the control lever 380 is in a position in which the opposite part of the control lever 380 does not overlap the container body 306 in the direction of fitting the lid member 340 to the container body 306 (the up-and-down direction in this exemplary embodiment), the control lever 380 does not obstruct mounting of the lid member 340 onto the container body 306.

At next step S80, the covering member 342 is so mounted over the container body 306 as to cover the lid member 340 from above. At this time, the manipulating part 382 is in the third position, and the manipulating part 382 is in a position not to overlap the container body 306 in the direction of fitting the container body 306 to the lid member 340 (the up-and-down direction in this exemplary embodiment). For this reason, the manipulating part 382 does not obstruct mounting of the covering member 342 onto the container body 306.

At next step S90, the control lever 380 is shifted from the third position to the second position. To shift the control lever 380 to the second position, the fixing stub 316 is disengaged from the through hole 390 by, for instance, deforming the front arm part 384 of the control lever 380. The shifting of the control lever 380 to the second position causes the manipulating part 382 of the control lever 380 to shift to a position to overlap the container body 306 in the direction of fitting the lid member 340 to the container body 306. As a result, the width of the holding container 300 is reduced in the direction crossing the direction of fitting the lid member 340 to the container body 306, and the carriage of the holding container 300 is facilitated. Further, even if it is attempted to return the control lever 380 having shifted to the second position to the third position, the front arm part 384 of the control lever 380 and the fixing stub 316 abut each other and interfere, and the control lever 380 is prevented from shifting to the third position when the shift is unnecessary.

Even if the control lever 380, when it is to be shifted from the third position to the second position, is shifted by mistake from the second position to the first position, there is a fear that the ejection hole 312 may be opened to let toner discharged through the ejection hole 312, but unless it is mounted in the image forming device body 20, it is so disposed that the forbidding stub 318 will prevent the control lever 380 from shifting from the second position to the first position.

Figure 25:
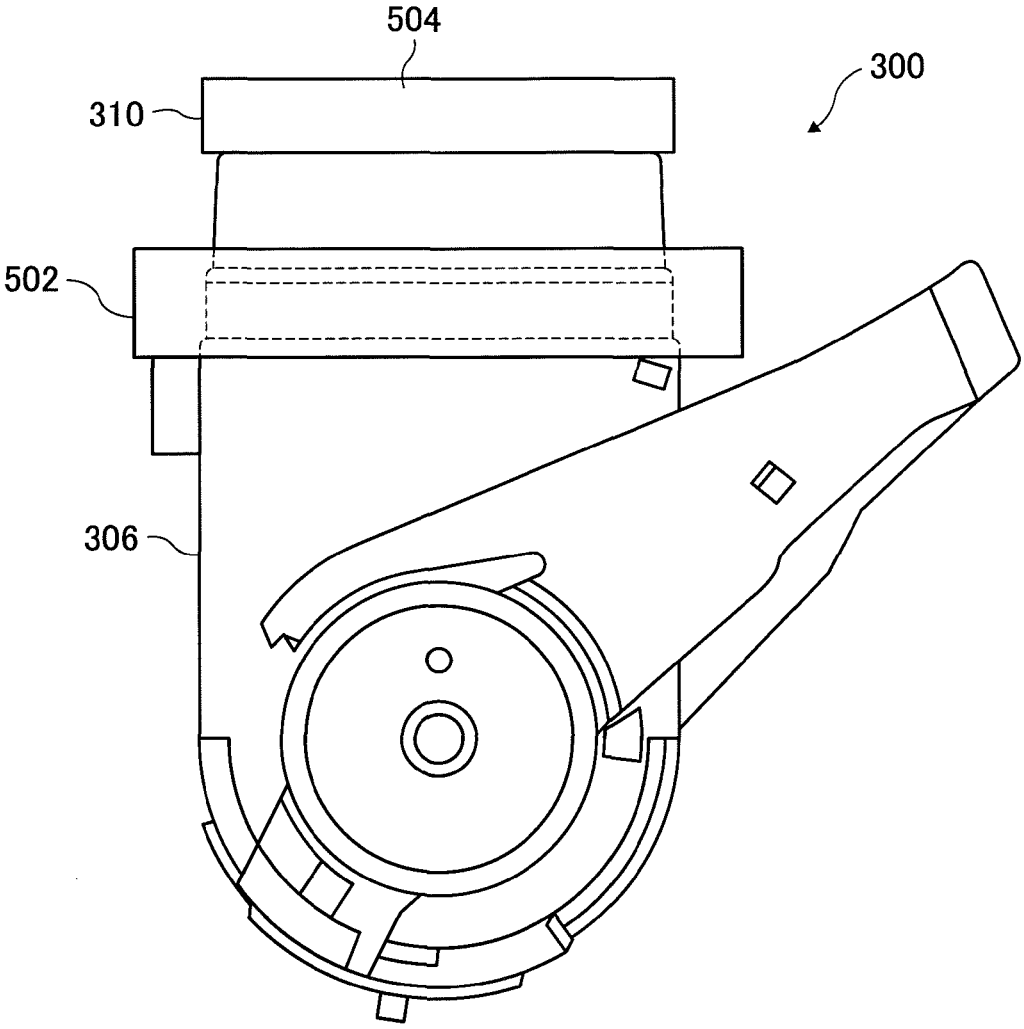
FIG. 25 illustrates a process in which an upper sub-container is fixed to the container body of a holding container pertaining to the exemplary embodiment of the present invention.

FIG. 25 illustrates a method of fixing the upper sub-container 310 to the container body 306 at step S40. As shown in FIG. 25, the area between the container body 306 and the upper sub-container 310 is pressed by a weld pressing member 502, a weld horn 504 is pressed against the upper sub-container 310 from above the upper sub-container 310 for instance, and in this state the container body 306 and the upper sub-container 310 are welded together. At this time, the manipulating part 382 of the control lever 380 is placed in a position where they do not interfere with the weld pressing member 502 and the weld horn 504. For this reason, the pressing member 502 and the weld horn 504 can be readily fitted to the holding container 300, resulting in enhanced efficiency of the assembling work to fix the upper sub-container 310 to the container body 306.

Figure 26:
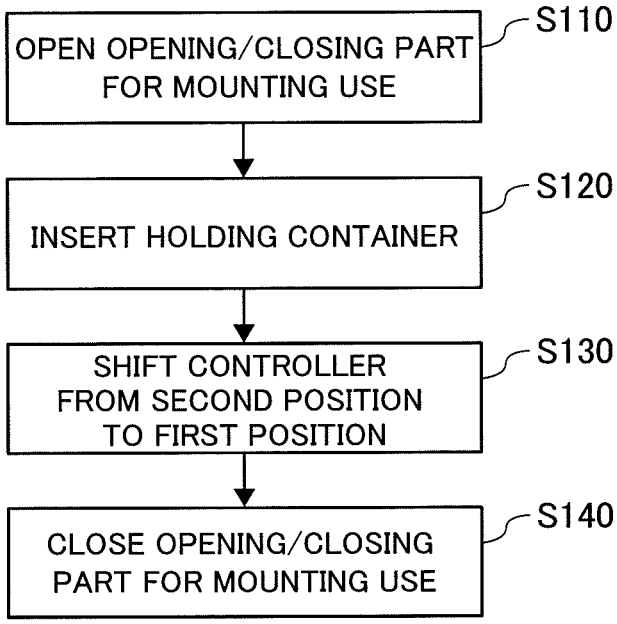
FIG. 26 charts the flow of a process in which a holding container pertaining to the exemplary embodiment of the present invention is mounted into an image forming device body.

FIG. 26 charts the flow of mounting a holding container 300 into the image forming device body 20. As charted in FIG. 26, at the first step S110, the opening/closing part 24 for mounting use fitted to the image forming device body 20 is opened to uncover the upper part of the mounting device 30.

At next step S120, the holding container 300 is inserted from above into the mounting device 30 in the image forming device body 20. At this step, the insertion member 56 so disposed as to protrude upward from the bottom face of the mounting device 30 is inserted between the container body 306 and the front arm part 384, and the front arm part 384 is deformed in a direction away from the container body 306 to shift to a position not to interfere with the forbidding stub 318. As a result, the control lever 380 is enabled to shift from the second position to the first position.

At next step S130, the control lever 380 is shifted from the second position to the first position to place the ejection hole 312 in an open state, in which toner can be supplied from the holding container 300 to the developing device 110.

At next step S140, the opening/closing part 24 for mounting use is closed. At this step, if there is any holding container whose control lever 380 has not shifted from the second position to the first position, the control lever 380 placed in the second position and the opening/closing part 24 for mounting use will interfere with each other, making it impossible to close the opening/closing part 24 for mounting use.

Figure 27:
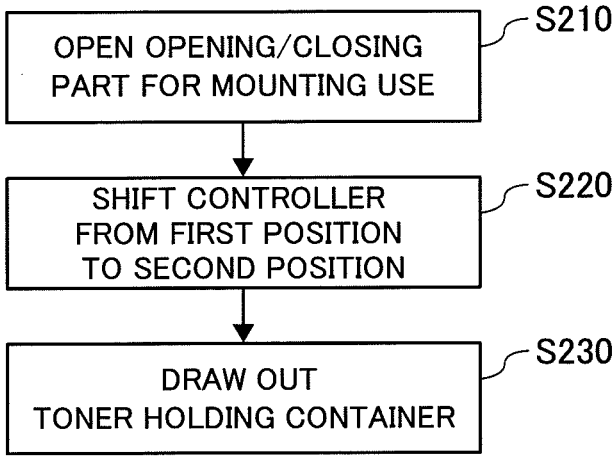
FIG. 27 charts the flow of a process in which a holding container pertaining to the exemplary embodiment of the present invention is detached from the image forming device body.

FIG. 27 charts the flow of taking the container body 306 out of the image forming device body 20. As charted in FIG. 26, at the first step S210, the opening/closing part 24 for mounting use is opened to uncover the upper part of the mounting device 30.

At next step S220, the control lever 380 is shifted from the first position to the second position to place the ejection hole 312 in a closed state. For this reason, when the holding container 300 is removed from the image forming device body 20, none of the remaining toner is discharged through the ejection hole 312.

At next step S230, the holding container 300 is drawn out of the image forming device body 20. If it is attempted to draw the holding container 300 out of the image forming device body 20 without shifting the control lever 380 from the first position to the second position, the guide stub 394 will interfere with the part of the left side plate 42 constituting the arciform part 50 and thereby make it impossible for the holding container 300 to be removed from the image forming device body 20.

Figure 28:
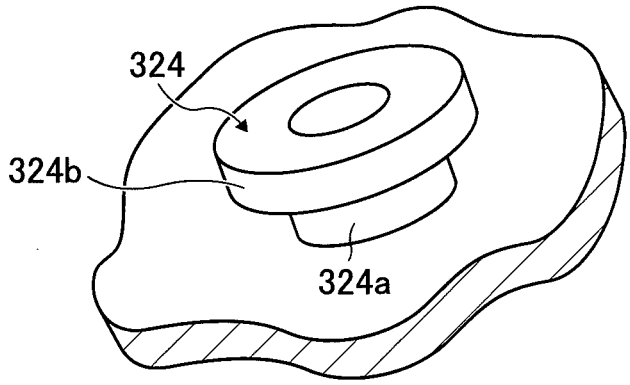
FIG. 28 is a perspective view showing a modified version of the supporting stub of the holding container pertaining to the exemplary embodiment of the present invention.
Figure 29:
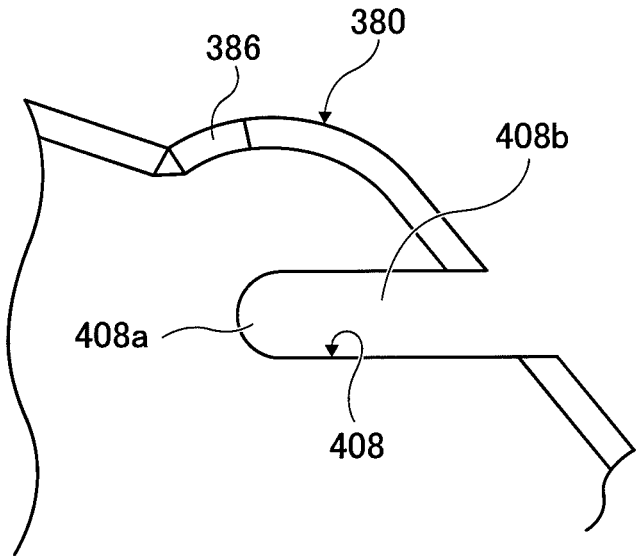
FIG. 29 is a profile showing a modified version of the through hole formed in the control lever of the holding container pertaining to the exemplary embodiment of the present invention.

FIG. 28 shows a modified version of the supporting stub 324 and FIG. 29, a modified version of the through hole 408 formed in the rear arm part 386 of the control lever 380.

In the exemplary embodiment of the present invention so far described, the supporting stub 324 is in a substantially columnar shape, having the protrusive part 326 protruding in the circumferential direction in a position distant from the front face of the container body 306 (see FIG. 14). Meanwhile, the supporting stub 324 of this modified version has a smaller diameter part 324*a* having a substantially columnar shape and a larger diameter part 324*b* disposed on the container body 306 on the side reverse to the front face of the smaller diameter part 324*a* and larger in diameter than the smaller diameter part 324*a*.

Further in the exemplary embodiment of the present invention so far described, the through hole 408 is in a substantially round shape, and the larger bore part 410 is so formed in a part of the through hole 408 in the circumferential direction as to be greater in bore than elsewhere (see FIG. 16). Meanwhile, the through hole 408 of this modified version has a semicircular part 408*a* having a slightly larger radius than that of the smaller diameter part 324*a* of the supporting stub 324 and a linear part 408*b* extending in a substantially linear shape from the semicircular part 408*a* to the edge part of the rear arm part 386. The width of the linear part 408*b* is prescribed to be slightly greater than the radius of the smaller diameter part 324*a*.

In this modified version, at the step of fitting the control lever 380 to the container body 306, the control lever 380 is fitted to the container body 306 in such a way that the end side of the semicircular part 408*a* reverse to the linear part 408*b* is inserted into a groove part formed underneath the larger diameter part 324*b* of the supporting stub 324. Further, the control lever 380 is so guided by a guiding part (not shown) as to be placed in the fourth position at the time of fitting the control lever 380 to the container body 306.

In the foregoing description of the exemplary embodiment of the present invention, a combination of two members, the opening/closing member 352 and the sealing member 354, is cited as an example of the opening/closing part 350, but the opening/closing part 350 may as well be a single component or a combination of three or more components.

In the foregoing description of the exemplary embodiment of the present invention so far described, a configuration in which the control lever 380 shifts to the first, second, third and fourth positions is cited as an example of its actions, but the control lever 380 may as well be shifted to one or more other positions in addition to the first, second, third and fourth positions.

In the foregoing description of the exemplary embodiment of the present invention, a configuration is cited in which the lid member 340 is used as a sealing part so fitted to the container body 306 as to seal the replenishing hole 314, the replenishing hole 314 is so sealed as to snap the lid member 340 into the replenishing hole 314 and the covering member 342 is so mounted over the container body 306 as to cover the lid member 340. However, the covering member 342 is not absolutely necessary. Or, instead of snapping the lid member 340 into the replenishing hole 314, the replenishing hole 314 may as well be sealed by using a tape having an adhesive portion and sticking the tape to cover the replenishing hole 314. When the replenishing hole 314 is to be sealed with a tape in this manner, the covering member 342 may as well be so mounted over the container body 306 as to cover the tape or the covering member 342 need not be mounted over the container body 306.

It is also possible, for instance, to fit a distinguishing member for distinguishing the holding container 300 to the lid member 340 or the tape referred to above, so fitted to the container body 306 as to seal the replenishing hole 314 or to the covering member 342 so fitted as to cover the lid member 340 or the tape. Examples of the distinguishing members include a distinguishing label that can be stuck to the lid member 340 or elsewhere. The distinguishing member would bear marking of, for instance, the type number of the holding container 300, the type number of the image forming device 10 permitting mounting of the holding container 300, the product name of the holding container 300, the product name of the image forming device 10 permitting mounting of the holding container 300, and the color of the toner contained in the container body 306 (whether the contained toner is yellow, magenta, cyan or black).

It is also possible to fit an explanatory member explaining how to use the holding container 300 to, for instance, the lid member 340 or the tape referred to above, so fitted to the container body 306 as to seal the replenishing hole 314 or to the covering member 342 so fitted as to cover the lid member 340 or the tape. Examples of the explanatory members include an explanatory label that can be stuck to the lid member 340. The explanatory member would bear marking of, for instance, how to mount the holding container 300 into the image forming device body 20 and take the holding container 300 out of the image forming device body 20. More specifically, for instance, how to manipulate the control lever 380 when the holding container 300 is to be mounted into the image forming device body 20 and when the holding container 300 is to be taken out of the image forming device body 20. Such an explanatory member may either be integrated with the distinguishing member as a single member to serve the two purposes concurrently or the explanatory member and the distinguishing member may as well be separate members.

Further, instead of fitting a distinguishing member and/or an explanatory member as separate elements, the distinguishing label and the explanatory label may as well be used as the tape referred to above.

Although the holding container is supposed to be filled with powder toner, as an example of image forming agent, in the foregoing description of the exemplary embodiment of the present invention so far described, the present invention can as well be applied to cases where the container is to be filled with liquid, such as ink.

Further in the exemplary embodiment of the present invention so far described, a printer is supposed to be used as an example of image forming device. However, other single-functional devices involving a step of using image forming agent, such as a copying machine or a facsimile device, and others having multiple functions and involving a step of using image forming agent, such as a printer or a scanner, are also included in the image forming devices according to the present invention. The present invention can be applied to these image forming devices. Devices, such as a television set, a DVD player and an HDD, which form images by using image forming agent, are also included in the image forming devices according to the present invention, and the present invention can be applied to these image forming devices, too. Furthermore, image forming devices built into a desk, shelf, wall or the like and forming images by using image forming agent are also included in the image forming devices according to the present invention, and the present invention can be applied to these image forming devices, too.

As hitherto described, the present invention can be applied to image forming agent holding containers, image forming devices, and methods of filling image forming agent.

The foregoing description of the exemplary embodiment of the present invention has been provided for the purposes of illustration and description. It is not intended to be exhaustive or to limit the present invention to the precise forms disclosed. Obviously, many modifications and variations will be apparent to practitioners skilled in the art. The exemplary embodiment was chosen and described in order to best explain the principles of the present invention and its practical applications, thereby enabling others skilled in the art to understand the present invention for various embodiments and with the various modifications as are suited to the particular use contemplated. It is intended that the scope of the present invention be defined by the following claims and their equivalents.

What is claimed is:

1. An image forming agent holding container comprising:

a container body that is installable into and removable from an image forming device body and in which an ejection hole for use in ejection of image forming agent is formed, a cover covering a filling hole formed in the container body;

an opening/closing part that is shiftably mounted on the container body so as to open and close the ejection hole, and a manipulating part turnably supported by the container body to be used for shifting the opening/closing part relative to the container body, the manipulating part shifting to and from an open position to place the ejection hole in an open state, a sealing position to place the ejection hole in a sealed state, and a filling position where the manipulating part is not disposed above the cover and the ejection hole being in the sealed state.

2. The image forming agent holding container according to claim 1, further comprising a mixing device that is fitted to the container body and mixes or carries the image forming agent held in the container body, wherein the manipulating part, when having shifted to a fitting position to fit the manipulating part to the container body, goes into a state of being placed in a position not to overlap the container body in a direction of fitting the mixing device to the container body, and when having shifted to one of the sealing position and the open position, goes into a state of being placed in a position to overlap the container body in the direction of fitting the mixing device to the container body.

3. The image forming agent holding container according to claim 2, further comprising a shift forbidding part that forbids, while allowing the manipulating part to shift from the fitting position to one of the open position and the sealing position, the manipulating part from shifting from one of the open position and the sealing position to the fitting position.

4. The image forming agent holding container according to claim 2, wherein the manipulating part is linked to the opening/closing part as an action interlocked with the shifting thereof in a direction from the fitting position toward the sealing position.

5. The image forming agent holding container according to claim 2, further comprising a fitting member that is welded onto the container body with a welding device, wherein the manipulating part is placed in a position not to interfere with the welding device in the fitting position thereof.

6. The image forming agent holding container according to claim 1, wherein the image forming agent holding container further has an anchoring part that anchors the manipulating part in the filling position.

7. The image forming agent holding container according to claim 6, further comprising an interfering part that interferes with the image forming device body when the image forming agent holding container is mounted into the image forming device body in a state in which the manipulating part is placed in the filling position.

8. The image forming agent holding container according to claim 1, wherein the container body further has an opening forbidding part that interferes with the opening/closing part when the container body is not mounted in the image forming device body and thereby forbids the opening/closing part from shifting so as to open the ejection hole.

9. The image forming agent holding container according to claim 1, further comprising a shift forbidding device that forbids the manipulating part from shifting to the open position in a state in which the manipulating part is not mounted in the image forming device body.

10. An image forming device having:

an image forming agent holding container for holding image forming agent, and an image forming part that forms an image by using image forming agent held in the image forming agent holding container, the image forming agent holding container having a container body that is installable into and removable from an image forming device body and in which an ejection hole for use in ejection of image forming agent is formed, a cover covering a filling hole formed in the container body, an opening/closing part that is shiftably mounted on the container body so as to open and close the ejection hole, and a manipulating part turnably supported by the container body to be used for shifting the opening/closing part relative to the container body, and the manipulating part shifting to and from an open position to place the ejection hole in an open state, a sealing position to place the ejection hole in a sealed state, and a filling position where the manipulating part is not disposed above the cover and the ejection hole being in the sealed state.

11. The image forming device according to claim 10, further comprising a removal forbidding device that forbids the image forming agent holding container from being removed out of the image forming device body in a state in which the manipulating part is positioned in the open position.

12. A method of filling image forming agent comprising:

fitting the fitting part to the container body, in a state in which, in an image forming agent holding container having a container body that is installable into and removable from an image forming device body and in which an ejection hole for use in ejection of image forming agent is formed, a cover covering a filling hole formed in the container body, an opening/closing part that is shiftably mounted on the container body so as to open and close the ejection hole, and a manipulating part turnably supported by the container body to be used for shifting the opening/closing part relative to the container body, the manipulating part shifting to and from an open position to place the ejection hole in an open state, a sealing position to place the ejection hole in a sealed state, and a filling position where the manipulating part is not disposed above the cover and the ejection hole being in a sealed state, placing the manipulating part is placed in the filling position;

filling the container body with image forming agent when the manipulating part is placed in the filling position; and shifting the manipulating part to the sealing position after filling the container body.

* * * * *